US009285182B2

(12) United States Patent
Bednar et al.

(10) Patent No.: US 9,285,182 B2
(45) Date of Patent: Mar. 15, 2016

(54) CONNECTABLE TWO PIECE BOWSTRING ENGAGING MECHANISM FOR CROSSBOW

(71) Applicant: Hunter's Manufacturing Company, Inc., Sufffield, OH (US)

(72) Inventors: Richard L. Bednar, Munroe Falls, OH (US); Michael J. Shaffer, Mogadore, OH (US); Jacob A. Hout, Akron, OH (US)

(73) Assignee: Hunter's Manufacturing Company, Inc., Suffield, OH (US)

( * ) Notice: Subject to any disclaimer, the term of this patent is extended or adjusted under 35 U.S.C. 154(b) by 258 days.

(21) Appl. No.: 14/169,479

(22) Filed: Jan. 31, 2014

(65) Prior Publication Data

US 2015/0013654 A1 Jan. 15, 2015

Related U.S. Application Data

(60) Provisional application No. 61/846,341, filed on Jul. 15, 2013.

(51) Int. Cl.

| | |
|---|---|
| ***F41B 5/18*** | (2006.01) |
| ***F41B 5/12*** | (2006.01) |
| ***F41B 5/14*** | (2006.01) |

(52) U.S. Cl.

CPC ..... *F41B 5/1469* (2013.01); *F41B 5/12* (2013.01); *F41B 5/123* (2013.01)

(58) Field of Classification Search

CPC ..... F41B 5/1469; F41B 5/12; F41B 5/123; F41B 5/1411

See application file for complete search history.

(56) References Cited

U.S. PATENT DOCUMENTS

| | | | | |
|---|---|---|---|---|
| 5,243,956 | A | 9/1993 | Luehring | |
| 6,095,128 | A | 8/2000 | Bednar | |
| 6,286,496 | B1 | 9/2001 | Bednar | |
| 6,705,304 | B1 * | 3/2004 | Pauluhn | F41B 5/12 124/25 |
| 6,868,845 | B1 * | 3/2005 | Moore | F41B 5/126 124/25 |
| 6,913,007 | B2 | 7/2005 | Bednar | |
| 7,100,590 | B2 * | 9/2006 | Chang | F41B 5/1469 124/25 |
| 7,624,725 | B1 | 12/2009 | Choma | |
| 8,104,461 | B2 * | 1/2012 | Kempf | F41B 5/12 124/25 |
| 8,439,024 | B2 * | 5/2013 | Barnett | F41B 5/1469 124/25 |
| 8,453,631 | B1 * | 6/2013 | Kronengold | F41A 11/02 124/25 |
| 2006/0086346 | A1 * | 4/2006 | Middleton | F41B 5/12 124/25 |
| 2009/0277435 | A1 * | 11/2009 | Pestrue | F41B 5/1469 124/25 |
| 2011/0232619 | A1 * | 9/2011 | Bednar | F41B 5/1469 124/86 |
| 2012/0037139 | A1 * | 2/2012 | Barnett | F41B 5/1469 124/86 |

* cited by examiner

*Primary Examiner* — Melba Bumgarner
*Assistant Examiner* — Amir Klayman
(74) *Attorney, Agent, or Firm* — Emerson Thomson Bennett, LLC; Timothy D. Bennett

(57) ABSTRACT

A manually assisted bowstring drawing mechanism may be used with a crossbow. The drawing mechanism may include a pair of handles attached to opposite ends of a rope and an engaging mechanism. The engaging mechanism may have two pieces that may receive the rope and may be selectively separated and connected together. When separated, the pieces may be extended up opposite sides of the crossbow from a trigger mechanism to a bowstring. The pieces may then be connected together and engaged to the bowstring. Next, the handles may be pulled by a user to move the bowstring from an uncocked position to a cocked position.

20 Claims, 17 Drawing Sheets

CONNECTABLE TWO PIECE BOWSTRING ENGAGING MECHANISM FOR CROSSBOW

This application claims priority to a provisional patent application filed Jul. 15, 2013, entitled CONNECTABLE TWO PIECE BOWSTRING ENGAGING MECHANISM FOR CROSSBOW, having Ser. No. 61/846,341.

I. BACKGROUND

A. Field of the Invention

This invention generally relates to methods and apparatuses related to crossbows and more specifically to methods and apparatuses related to manually assisted crossbow drawing mechanisms.

B. Description of Related Art

FIG. 1 shows a typical crossbow 10. The crossbow 10 may have a longitudinally extending main beam 12 and two outwardly extending limbs 14 which extend transversely on opposite sides of the main beam 12 from a riser 32 that may be mounted to the main beam 12. A bowstring 16 may be strung between the distal ends of the limbs 14. The main beam 12 may have a rear portion or tailstock 18 having an integrally formed butt portion 20. Butt portion 20 is normally positioned against the user's shoulder when the crossbow 10 is being aimed and fired. The main beam 12 may include an upper surface which has a longitudinally extending arrow reception groove 34 on which a projectile, such as an arrow, is positioned. The bowstring 16 may slide on this upper surface in operation of the crossbow 10. A trigger mechanism 22 of any suitable type may be supported to the main beam 12 and used to hold the bowstring 16 in a cocked condition and to release the bowstring 16. The crossbow 10 may also have a pair of pulley wheels, cams or other known devices 24 affixed to the limbs 14 to carry the bowstring 16 and one or more tension cable(s) 26 in a compound bow arrangement.

Still referring to FIG. 1, in order to operate the crossbow 10, a force must be applied to the bowstring 16 to move it from an uncocked or undrawn position, as shown in FIG. 1, to a cocked or drawn position where the bowstring 16 is held by the trigger mechanism 22. There are three general methods for applying this force to the bowstring 16. One method may be referred to as manually unassisted. For this method, no device assists the user. The user places the distal outer surface of the stirrup bracket 28 on a ground surface, places his foot into the stirrup opening 30 to thereby use his weight to hold the distal end of the stirrup bracket 28 to the ground surface, bends down to grasp the bowstring 16 with his fingers, and then pulls or draws the bowstring 16 proximally (away from the stirrup bracket 28 and toward butt portion 20) until the bowstring 16 is held or engaged by the trigger mechanism 22. While this method generally works well, it has the disadvantage of requiring the user to apply a relatively large force in order to draw the bowstring 16 to the trigger mechanism 22. Such a relatively large force makes it difficult for many users and impossible for some users to operate the crossbow. Another disadvantage of manually unassisted drawing is that generally the bowstring 16 is not drawn in an even or balanced manner so that both limbs 14 are tensioned to the same degree. Such unbalanced drawing of the bowstring 16 reduces the accuracy of the resultant shot made by the user.

With continuing reference to FIG. 1, a second method of drawing the bowstring 16 is by using an automated device (not shown). For this method, the user applies no or very little force when drawing the bowstring 16. Known automated bowstring drawing devices include motors, or other force generating devices, which may be mounted to the main beam 12. While some automated devices generally work well, they have the disadvantage of increasing the cost and the weight of the crossbow. Depending on the quality of the automated device and its installation and operation, the bowstring 16 may still be drawn in an uneven or unbalanced manner, reducing the accuracy of the resultant shot.

Still referring to FIG. 1, a third method of drawing the bowstring 16 is by using what may be referred to as a manually assisted device. For this method, a device assists the user in drawing the bowstring 16 but the user still must apply some significant, though relatively small, force. One such known device is a manual crank winch (not shown). While such winches reduce the required user force, they are often large, heavy and cumbersome. They also must be connected and disconnected from the crossbow with each use. Furthermore, they often fail to draw the bowstring 16 in an even or balanced manner. Several other manual assist devices are known but none of them provide consistent balanced performance.

With reference now to FIGS. 1-3, another example of a manually assisted device is the bowstring drawing mechanism 40. Drawing mechanism 40 may include two handles 42, 44 that support opposite ends of a string or rope 46. At least one of the handles, handle 42 in this case, may have a retracting mechanism 48 within the handle that provides a tension force on the rope 46 to "take up" or prevent unwanted "play" or "slack" in the rope 46. The retracting mechanism 48 may operate in a manner similar to the retracing mechanisms used in automobile seat belt systems. The drawing mechanism 40 may also include a bowstring engaging mechanism 50 that is used to engage or connect the rope 46 to the bowstring 16. The bowstring engaging mechanism 50 may include a pair of identical (or nearly so) engaging pieces 52, as shown. Each engaging piece 52 may have a first end 54 that receives the rope 46 and a second end 56 that receives the bowstring 16. For the example shown, the first ends 54 include a roller that is rotatable with respect to the engaging piece 52 about the longitudinal axis of a pivot pin that receives the roller. The roller has a rope contact surface that contacts the rope 46. The second ends 56 have hooks 58.

With continuing reference to FIGS. 1-3, to use the drawing mechanism 40, the user places the distal outer surface of the stirrup bracket 28 on a ground surface and places his foot into the stirrup opening 30 to thereby use his wait to hold the distal end of the stirrup bracket 28 to the ground surface. Next, the user pulls the handles 42, 44 apart and contacts the rope 46 to a proximal portion of the main beam 12 (such as to a handle or to the proximal end of the butt portion 20). As the rope 46 continues to come out of the handle(s), the user then attaches the hook 58 of one engaging piece 52 to the bowstring 16 on one side of the main beam 12 and the hook 58 of the other engaging piece 52 to the bowstring 16 on the other side of the main beam 12. The hooks 58 may be attached simultaneously. Next, the user pulls on the handles 42, 44 (one hand on each handle) proximally until the rope 46 is fully extended out of the handles 42, 44. The user continues to pull on the handles 42, 44 but now causes the bowstring 16 to move proximally until the bowstring 16 is held or engaged by the trigger mechanism 22. This arrangement provides a mechanical advantage for the user that significantly reduces the force required by the user to draw the bowstring 16 into the cocked position. The user then removes the hooks 58 from the bowstring 16, removes the drawing mechanism 40 from the crossbow 10 and stores the drawing mechanism 40 (such as by putting it in a pocket). While this method generally works well, it has the disadvantage of not always drawing the bowstring 16 in an even or balanced manner.

What is needed, is a manually assisted bowstring drawing mechanism that includes two pieces that may be selectively separated and connected together. Also needed is a manually assisted bowstring drawing mechanism that draws the bowstring in an even/balanced manner so that both limbs are tensioned to the same degree. Such devices will be easy to use and will improve the accuracy of the resultant shots made by the user.

II. SUMMARY

According to one embodiment of this invention, a crossbow may include: a main beam that: extends longitudinally; has first and second sides with a width W1 between the first and second sides; and, has an upper surface suitable to receive an associated projectile to be shot by the crossbow; first and second limbs supported to the main beam that extend outwardly from proximal ends to distal ends on opposite sides of the main beam; a bowstring that is: strung between the distal ends of the first and second limbs; and, adjustable from an uncocked position to a cocked position; a trigger mechanism supported to the main beam and operable to hold the bowstring in the cocked position and operable to release the bowstring to fire the associated projectile; a crossbow rope reception surface that is longitudinally spaced from the bowstring when the bowstring is in the uncocked position; and, a manually assisted bowstring drawing mechanism. The drawing mechanism may include: a rope having first and second ends; a first handle attached to the first end of the rope; a second handle attached to the second end of the rope; and, an engaging mechanism. The engaging mechanism may include: a first engaging piece comprising: an engaging piece rope reception portion that receives the rope; a bowstring contact surface; and, a convex portion; and, a second engaging piece comprising: an engaging piece rope reception portion that receives the rope; a bowstring contact surface; and, a concave portion. The manually assisted bowstring drawing mechanism may be manually operable into: (1) a first condition where: (a) the bowstring is in the uncocked position; (b) the rope between the first and second handles and between the first and second engaging pieces contacts the crossbow rope reception surface; (c) the first handle, the first engaging piece and the first end of the rope are positioned on the first side of the main beam longitudinally between the crossbow rope reception surface and the bowstring; (d) the second handle, the second engaging piece and the second end of the rope are positioned on the second side of the main beam longitudinally between the crossbow rope reception surface and the bowstring; and, (e) the first and second engaging pieces are separated by a distance D2 where D2 is at least W1; (2) a second condition where: (a) the bowstring is in the uncocked position; (b) the rope between the first and second handles and between the first and second engaging pieces contacts the crossbow rope reception surface; (c) the convex portion of the first engaging piece is received in the concave portion of the second engaging piece thereby connecting the first engaging piece to the second engaging piece; (d) the bowstring contact surface of the first engaging piece contacts the bowstring; and, (e) the bowstring contact surface of the second engaging piece contacts the bowstring; and, (3) a third condition where: (a) the convex portion of the first engaging piece remains within the concave portion of the second engaging piece thereby maintaining the connection of the first engaging piece to the second engaging piece; (b) the rope between the first and second handles and between the first and second engaging pieces remains in contact with the crossbow rope reception surface; (c) the bowstring contact surface of the first engaging piece remains in contact with the bowstring; (d) the bowstring contact surface of the second engaging piece remains in contact with the bowstring; and, (e) a tension force applied by an associated user on the first and second handles causes the engaging mechanism to move the bowstring from the uncocked position to the cocked position.

According to another embodiment of this invention, a manually assisted bowstring drawing mechanism may be used with an associated crossbow. The associated crossbow may include: a main beam that: extends longitudinally; has first and second sides with a width W1 between the first and second sides; and, has an upper surface suitable to receive an associated projectile to be shot by the crossbow; first and second limbs supported to the main beam that extend outwardly from proximal ends to distal ends on opposite sides of the main beam; a bowstring that is: strung between the distal ends of the first and second limbs; and, adjustable from an uncocked position to a cocked position; a trigger mechanism supported to the main beam and operable to hold the bowstring in the cocked position and operable to release the bowstring to fire the associated projectile; and, a crossbow rope reception surface that is longitudinally spaced from the bowstring when the bowstring is in the uncocked position. The manually assisted bowstring drawing mechanism may include: a rope having first and second ends; a first handle attached to the first end of the rope; a second handle attached to the second end of the rope; and, an engaging mechanism. The engaging mechanism may include: a first engaging piece comprising: an engaging piece rope reception portion that receives the rope; a bowstring contact surface; and, a convex portion; and, a second engaging piece comprising: an engaging piece rope reception portion that receives the rope; a bowstring contact surface; and, a concave portion. The manually assisted bowstring drawing mechanism may be manually operable when used with the associated crossbow into: (1) a first condition where: (a) the bowstring is in the uncocked position; (b) the rope between the first and second handles and between the first and second engaging pieces contacts the crossbow rope reception surface; (c) the first handle, the first engaging piece and the first end of the rope are positioned on the first side of the main beam longitudinally between the crossbow rope reception surface and the bowstring; (d) the second handle, the second engaging piece and the second end of the rope are positioned on the second side of the main beam longitudinally between the crossbow rope reception surface and the bowstring; and, (e) the first and second engaging pieces are separated by a distance D2 where D2 is at least W1; (2) a second condition where: (a) the bowstring is in the uncocked position; (b) the rope between the first and second handles and between the first and second engaging pieces contacts the crossbow rope reception surface; (c) the convex portion of the first engaging piece is received in the concave portion of the second engaging piece thereby connecting the first engaging piece to the second engaging piece; (d) the bowstring contact surface of the first engaging piece contacts the bowstring; and, (e) the bowstring contact surface of the second engaging piece contacts the bowstring; (3) a third condition where: (a) the convex portion of the first engaging piece remains within the concave portion of the second engaging piece thereby maintaining the connection of the first engaging piece to the second engaging piece; (b) the rope between the first and second handles and between the first and second engaging pieces remains in contact with the crossbow rope reception surface; (c) the bowstring contact surface of the first engaging piece remains in contact with the bowstring; (d) the bowstring contact surface of the second engaging piece remains in contact with the bowstring; and, (e) a tension force applied by an associated user on the first and second handles causes the engaging mechanism to move the bowstring from the uncocked position to the cocked position; and, (4) a fourth condition where: (a) the bowstring is in the cocked position; and, (b) the engaging mechanism is removed from the bowstring.

According to yet another embodiment of this invention, a method may include the steps of: (A) proving a crossbow comprising: a main beam that: extends longitudinally; has first and second sides with a width W1 between the first and second sides; and, has an upper surface suitable to receive an associated projectile to be shot by the crossbow; first and second limbs supported to the main beam that extend outwardly from proximal ends to distal ends on opposite sides of the main beam; a bowstring that is: strung between the distal ends of the first and second limbs; and, adjustable from an uncocked position to a cocked position; a trigger mechanism supported to the main beam and operable to hold the bowstring in the cocked position and operable to release the bowstring to fire the associated projectile; a crossbow rope reception surface that is longitudinally spaced from the bowstring when the bowstring is in the uncocked position; and, wherein the bowstring is in the uncocked position; (B) providing a manually assisted bowstring drawing mechanism comprising: a rope having first and second ends; a first handle attached to the first end of the rope; a second handle attached to the second end of the rope; and, an engaging mechanism comprising: centering structure; a first engaging piece comprising: an engaging piece rope reception portion that receives the rope; a bowstring contact surface; and, a convex portion; and, a second engaging piece comprising: an engaging piece rope reception portion that receives the rope; a bowstring contact surface; and, a concave portion; (C) while the bowstring remains in the uncocked position: positioning the rope between the first and second handles and between the first and second engaging pieces on the crossbow rope reception surface; (D) while the bowstring remains in the uncocked position and the rope between the first and second handles and between the first and second engaging pieces remains on the crossbow rope reception surface: (1) positioning the first handle, the first engaging piece and the first end of the rope on the first side of the main beam longitudinally between the crossbow rope reception surface and the bowstring; (2) positioning the second handle, the second engaging piece and the second end of the rope on the second side of the main beam longitudinally between the crossbow rope reception surface and the bowstring; (3) inserting the convex portion of the first engaging piece into the concave portion of the second engaging piece thereby connecting the first engaging piece to the second engaging piece; (4) contacting the bowstring with the bowstring contact surface of the first engaging piece and the bowstring contact surface of the second engaging piece; (E) while the rope between the first and second handles and between the first and second engaging pieces remains on the crossbow rope reception surface, the convex portion of the first engaging piece remains inserted within the concave portion of the second engaging piece and the bowstring remains contacted by the bowstring contact surfaces of the first and second engaging pieces: applying a manual tension force on the first and second handles causing the engaging mechanism to move the bowstring from the uncocked position to the cocked position; and, (F) while the bowstring remains in the cocked position: removing

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION

Figure 4:
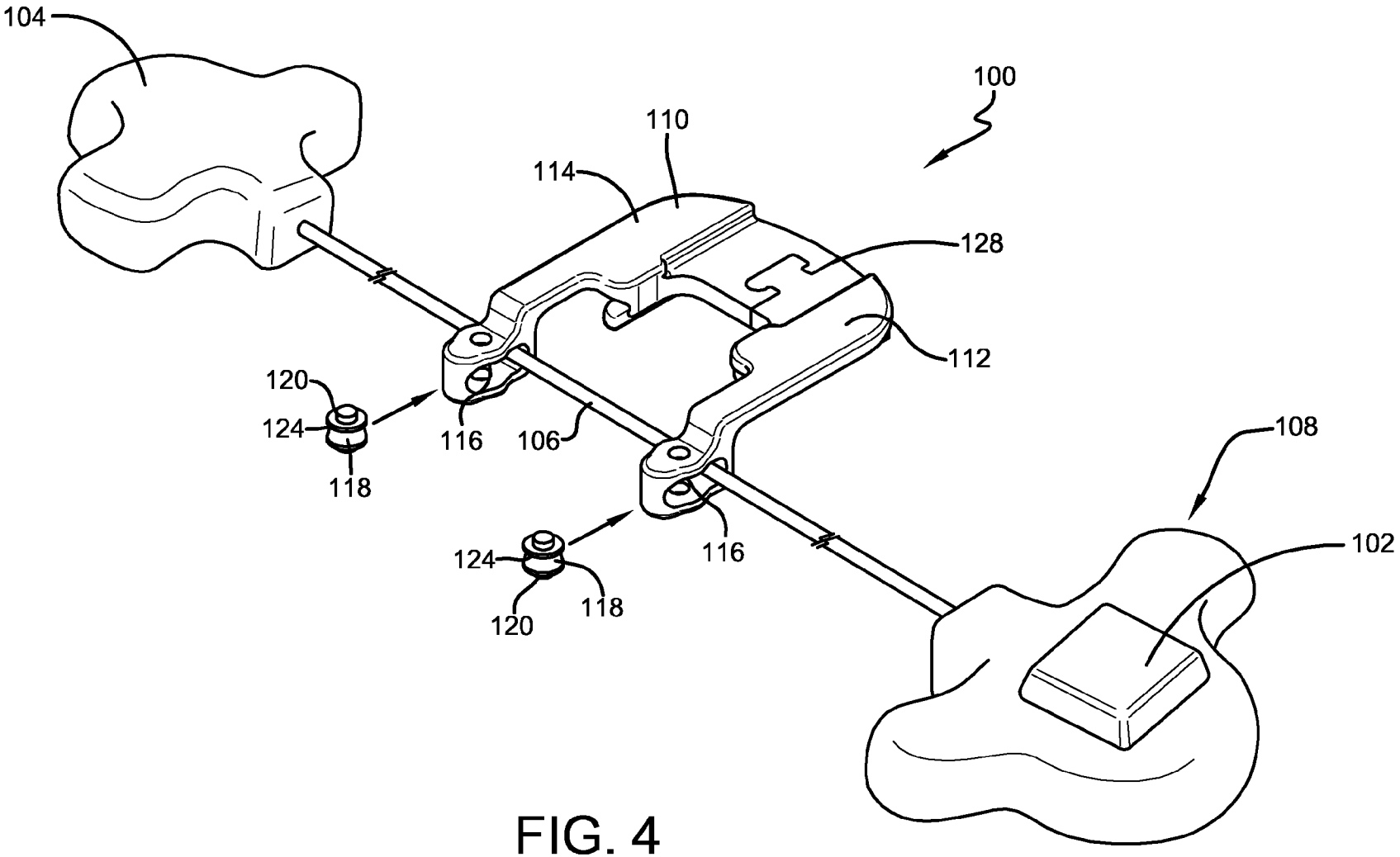
FIG. 4 is a partially exploded view of a drawing mechanism according to some embodiments of this invention.

Referring now to the drawings wherein the showings are for purposes of illustrating embodiments of the invention only and not for purposes of limiting the same, and wherein like reference numerals are understood to refer to like components, FIG. 4 illustrates a manually assisted drawing mechanism 100 that uses a bowstring engaging mechanism 110 according to some embodiments of this invention. The drawing mechanism 100 may be used with a crossbow such as crossbow 200 shown in FIGS. 5 and 6 and described below but this invention is not limited to any particular type or size of crossbow as long as it is used with the sound judgment of a person of skill in the art.

Figure 5:
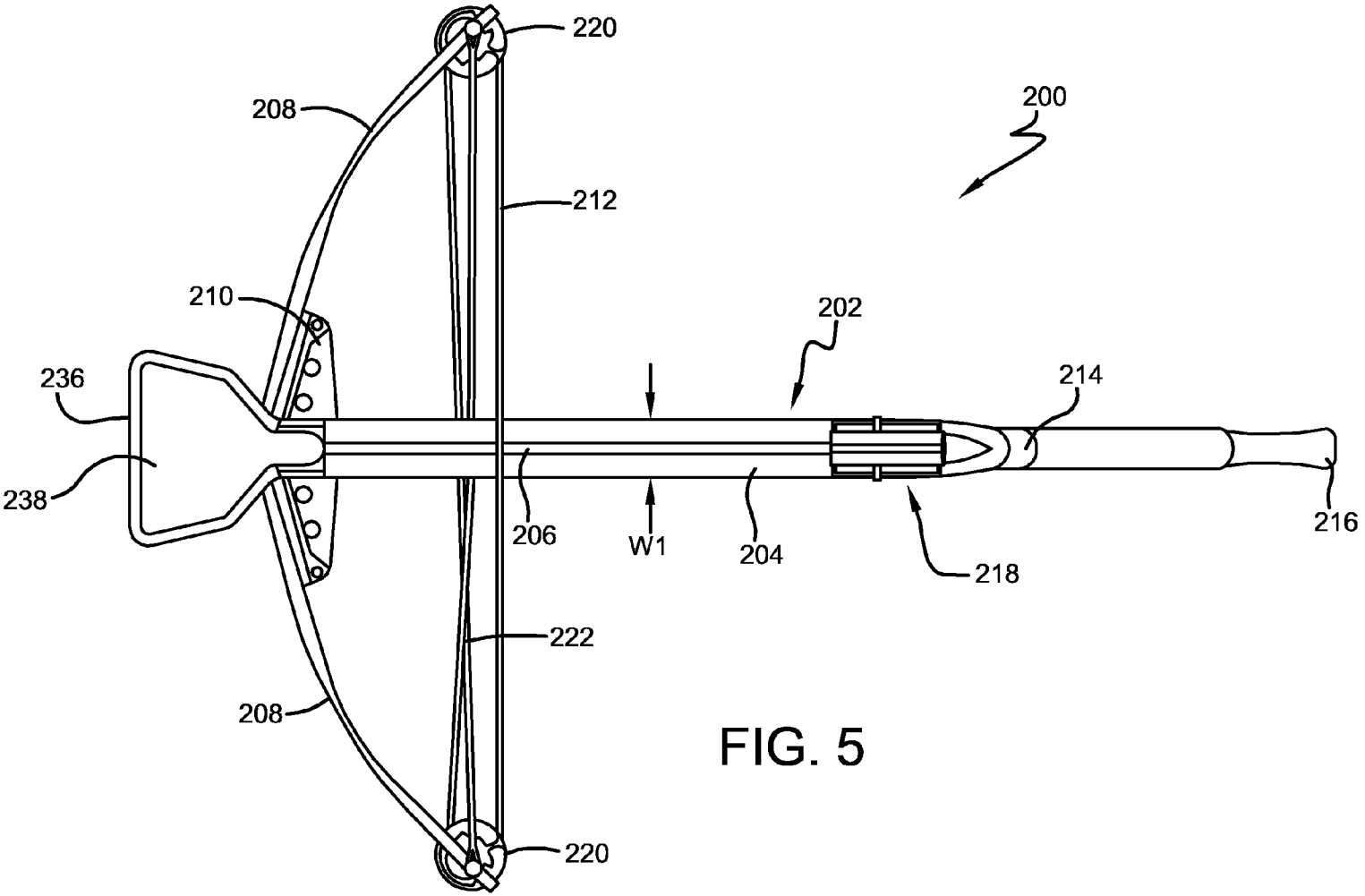
FIG. 5 is a top view of a crossbow that may use a drawing mechanism according to some embodiments of this invention.
Figure 6:
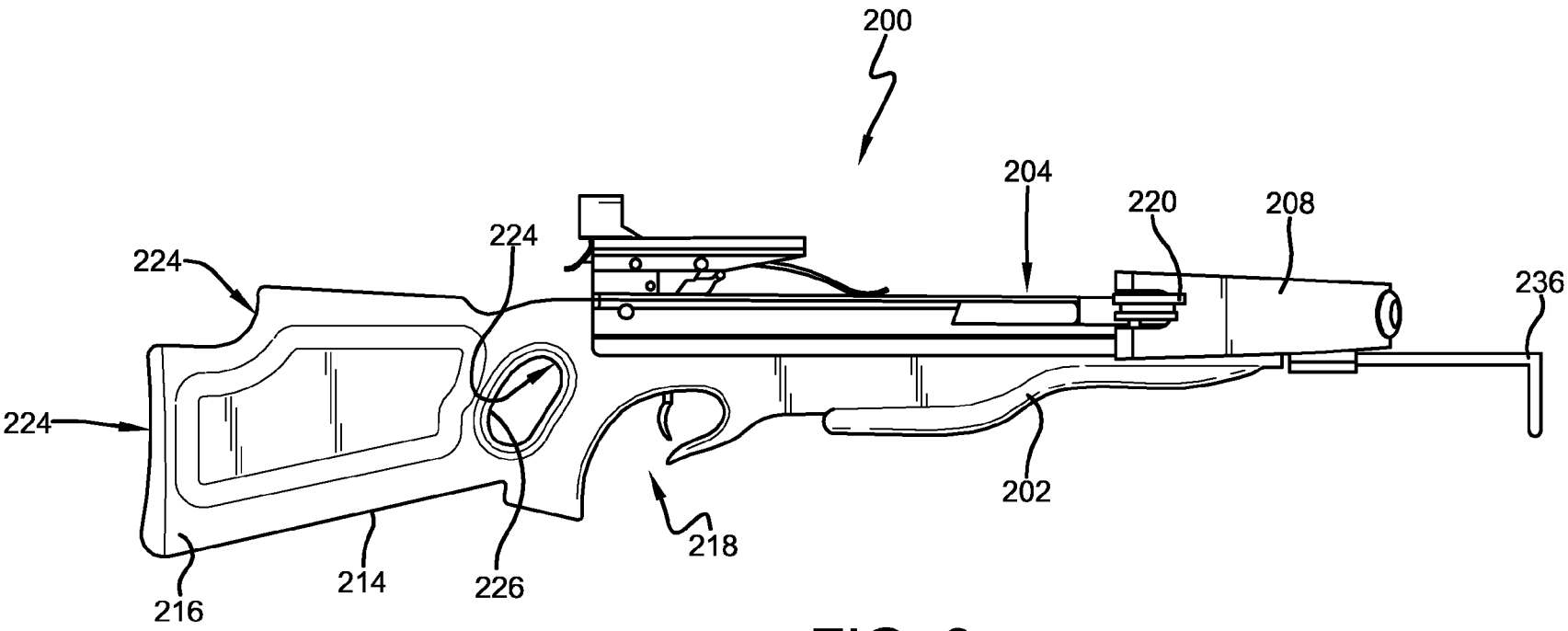
FIG. 6 is a side view of the crossbow shown in FIG. 5.
Figure 17:
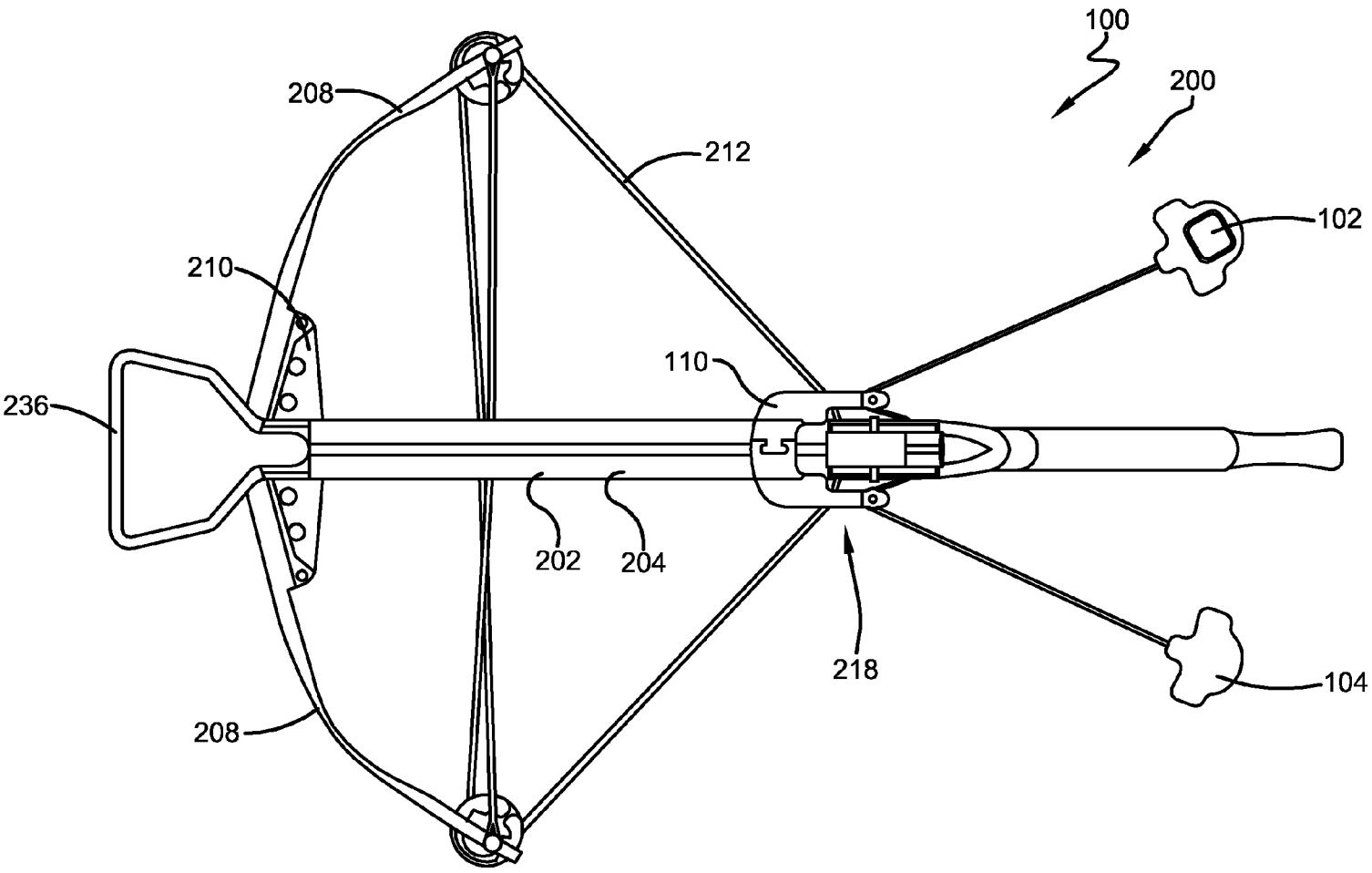
FIG. 17 is a top view of the crossbow of FIG. 5 showing the pieces of the engaging mechanism connected and used to draw the bowstring into the cocked position.

As shown in FIGS. 5-6, the crossbow 200 may have a main beam 202 that extends longitudinally and has first and second sides with a width W1 between them. The main beam 202 may have an upper surface 204 suitable to receive a projectile, such as an arrow, to be shot by the crossbow 200. An arrow reception groove 206 may be formed on the upper surface 204 of the main beam 202 and may extend longitudinally, as shown. A pair of limbs 208 may be supported to the main beam 202 and extend outwardly from proximal ends to distal ends on opposite sides of the main beam 202. For the embodiment shown, a riser 210 is supported directly to the main beam 202 and the limbs 208 are attached to the riser 210. A bowstring 212 may be strung between the distal ends of the limbs 208 and may be adjusted from an uncocked position, as shown in FIG. 5, to a cocked position, as shown in FIG. 17.

With continuing reference to FIGS. 5-6, the main beam 202 may have a rear portion or tailstock 214 having an integrally formed butt portion 216. Butt portion 216 is typically positioned against the user's shoulder when the crossbow 200 is being aimed and fired. A trigger mechanism 218 may be supported to the main beam 202 and may be operable to hold the bowstring 212 in the cocked position and operable to release the bowstring 212 to fire the projectile. Any trigger mechanism chosen with the sound judgment of a person of skill in the art may be used. The crossbow 200 may also have a pair of pulley wheels, cams or other known devices 220 affixed to the limbs 208 to carry the bowstring 212 and one or more tension cable(s) 222 in a compound bow arrangement, as shown. It should be noted, however, that this invention is not limited to use with compound bows. As shown in FIG. 6, one or more crossbow rope reception surfaces 224 that receive a later to be described rope may be located on the crossbow 200. The crossbow rope reception surface(s) 224 may be longitudinally spaced from the bowstring 212 when the bowstring 212 is in the uncocked position. FIG. 6 shows three non-limiting examples of crossbow rope reception surfaces 224, one at the proximal end of the butt portion 216, another one set in from the proximal end of the butt portion 216 and a third at the distal edge of an opening 226 formed in the tailstock 214. A stirrup bracket 236 may be supported to the main beam 202 and may define a stirrup opening 238 that is used to receive the user's foot.

Figure 1:
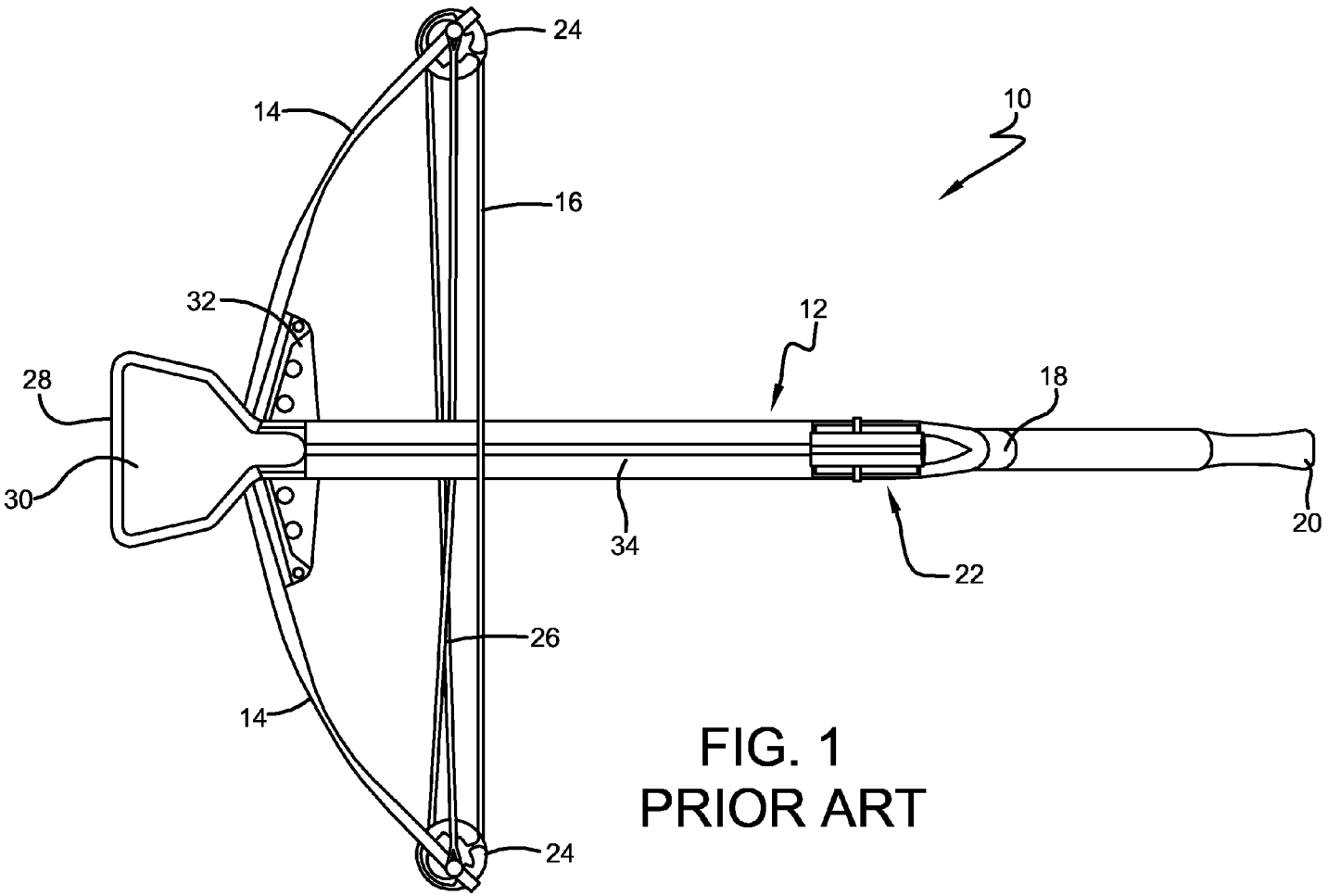
FIG. 1 PRIOR ART
FIG. 1 is a top view of a known crossbow.
Figure 2:
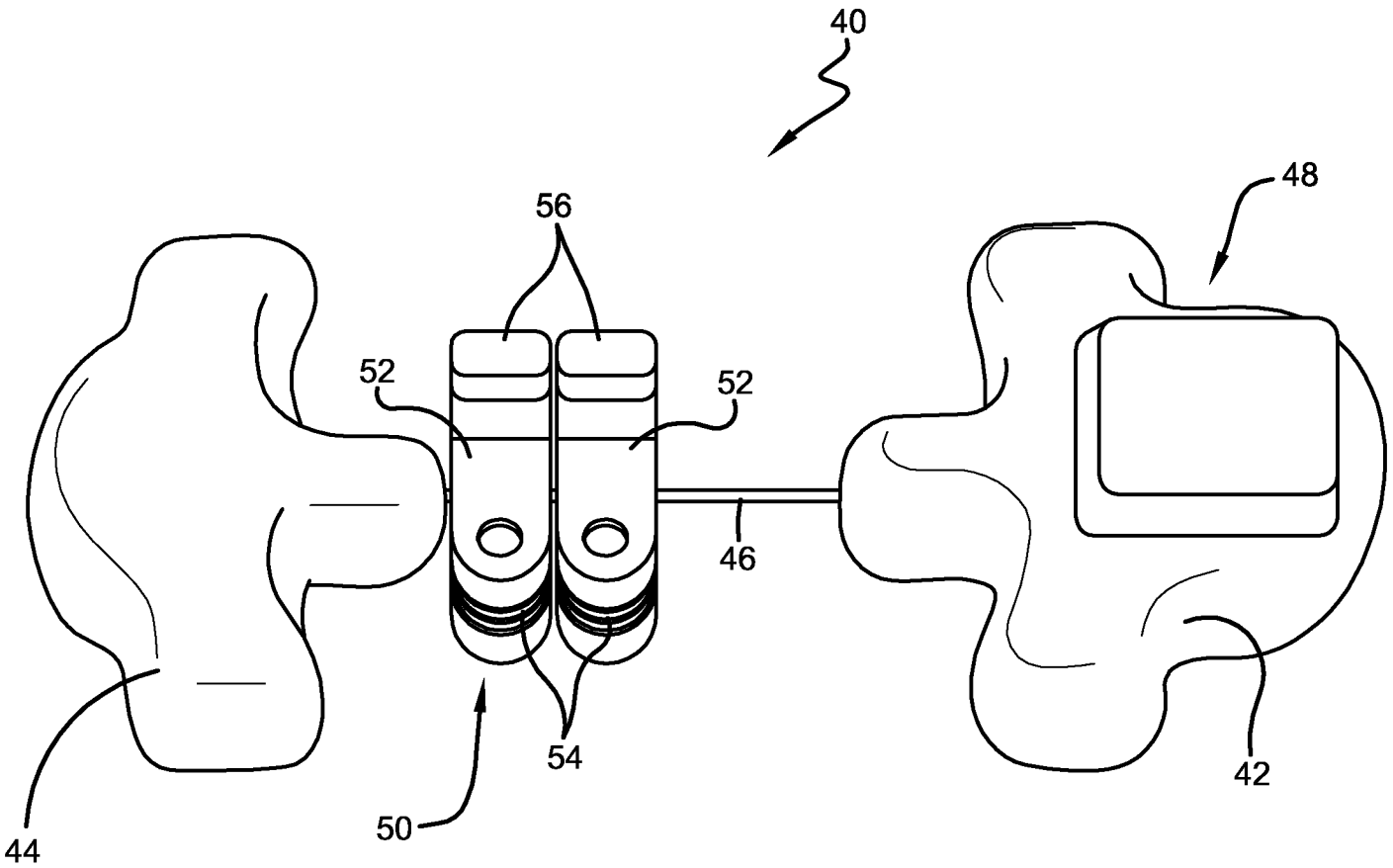
FIG. 2 PRIOR ART
FIG. 2 is a top view of a known drawing mechanism.
Figure 3:
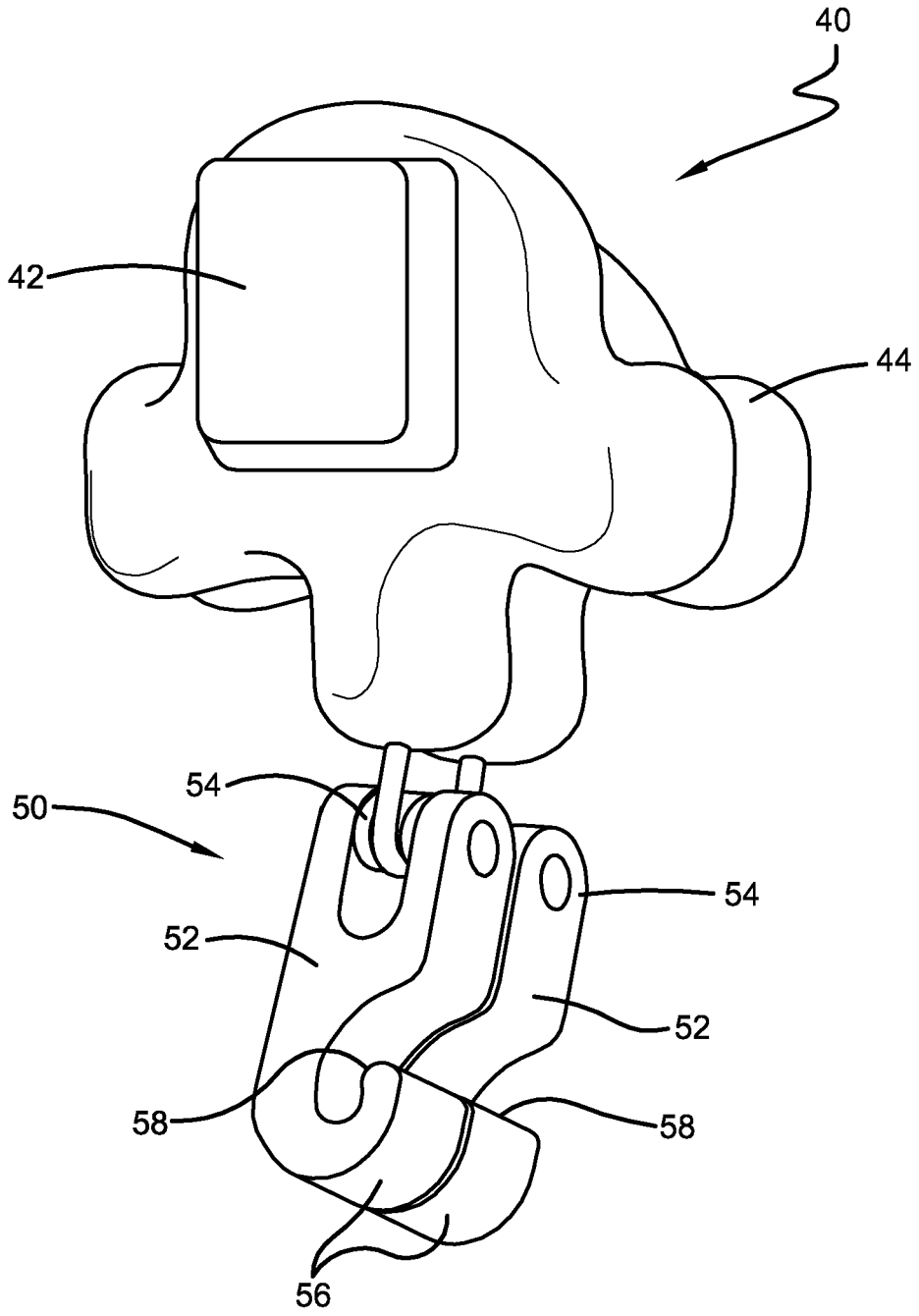
FIG. 3 PRIOR ART
FIG. 3 is a side view of the drawing mechanism shown in FIG. 2 but showing the components in a different relative position.

With reference now to FIG. 4, the manually assisted drawing mechanism 100 may include two handles 102, 104 that support opposite ends of a string or rope 106. At least one of the handles, handle 102 in this case, may have a retracting mechanism 108 within the handle that provides a tension force on the rope 106 to prevent any unwanted "play" or "slack" in the rope 106. As the handles 102, 104 and rope 106 may operate similar to the handles 42, 44 and rope 46 shown in FIGS. 2 and 3 and described above, further details will not be provided here.

With reference now to FIGS. 4-5 and 7-14, the bowstring engaging mechanism 110 may be used to engage or connect the rope 106 to the bowstring 212. The bowstring engaging mechanism 110 may include first and second engaging pieces 112, 114, as shown. The engaging pieces 112, 114 may have several features that are similar. These similar features will be described first. Each engaging piece 112, 114 may have an engaging piece rope reception portion 116, as seen best in FIGS. 4, 10 and 12, that receives the rope 106. For the embodiment shown, the rope reception portions 116 include slots formed at one end of the engaging pieces 112, 114. Each rope reception portion 116 may receive a roller 118 that is rotatable with respect to the corresponding engaging piece about the longitudinal axis of a pivot pin 120 that receives the roller 118 and is received within holes 122. Each roller 118 may have a rope contact surface 124 that contacts the rope 106. The rope contact surface 124 may be curved and the rope 106 may be received between the roller 118 and a surface that forms the slot, as shown. Each engaging piece 112, 114 may have a bowstring contact surface 126, as seen best in FIGS. 7, 10 and 12. For the embodiment shown, the bowstring contact surface 126 has a general U-shaped profile to better hold the bowstring 16 to the corresponding engaging piece 112, 114. The bowstring contact surface 126 may be formed on a portion that extends downwardly from a top surface of the engaging mechanism 110 and may face the rope reception portions 116, as shown.

The engaging pieces 112, 114 may be selectively separated and connected together. They are shown separated in FIGS. 12-15 and connected together in, for example, FIGS. 4, 7-11 and 16-17. For the embodiment shown, they are connectable via a common contact surface 128, see FIGS. 4, 7, 9 and 11, and via at least one convex portion 130 that extends from one piece and that is received in at least one concave portion 132 formed in the other piece, see FIGS. 7 and 12-14. For the embodiment shown, one convex portion 130 is received in one concave portion 132. While the convex and concave portions 130, 132 may be sized and shaped in any manner chosen with the sound judgment of skill in the art, for the embodiment shown, the convex portion 130 is T-shaped and the concave portion 132 has a matching T-shape. The convex portion 130 may have, as seen best in FIGS. 13 and 14, a length L1 and the concave portion 132 may have a length L2. In one embodiment, the lengths L1 and L2 may be between 0.2 inches and 1.0 inches. For the embodiment shown, the lengths L1 and L2 are about 0.6 inches. Both the convex and concave portions 130, 132 may have one portion 134, the top portion in the embodiment shown, that has a flat surface and a second portion 136, the bottom portion shown, that has a curved surface. This arrangement prevents a misconnection of the piece 112 to the piece 114.

Figure 7:
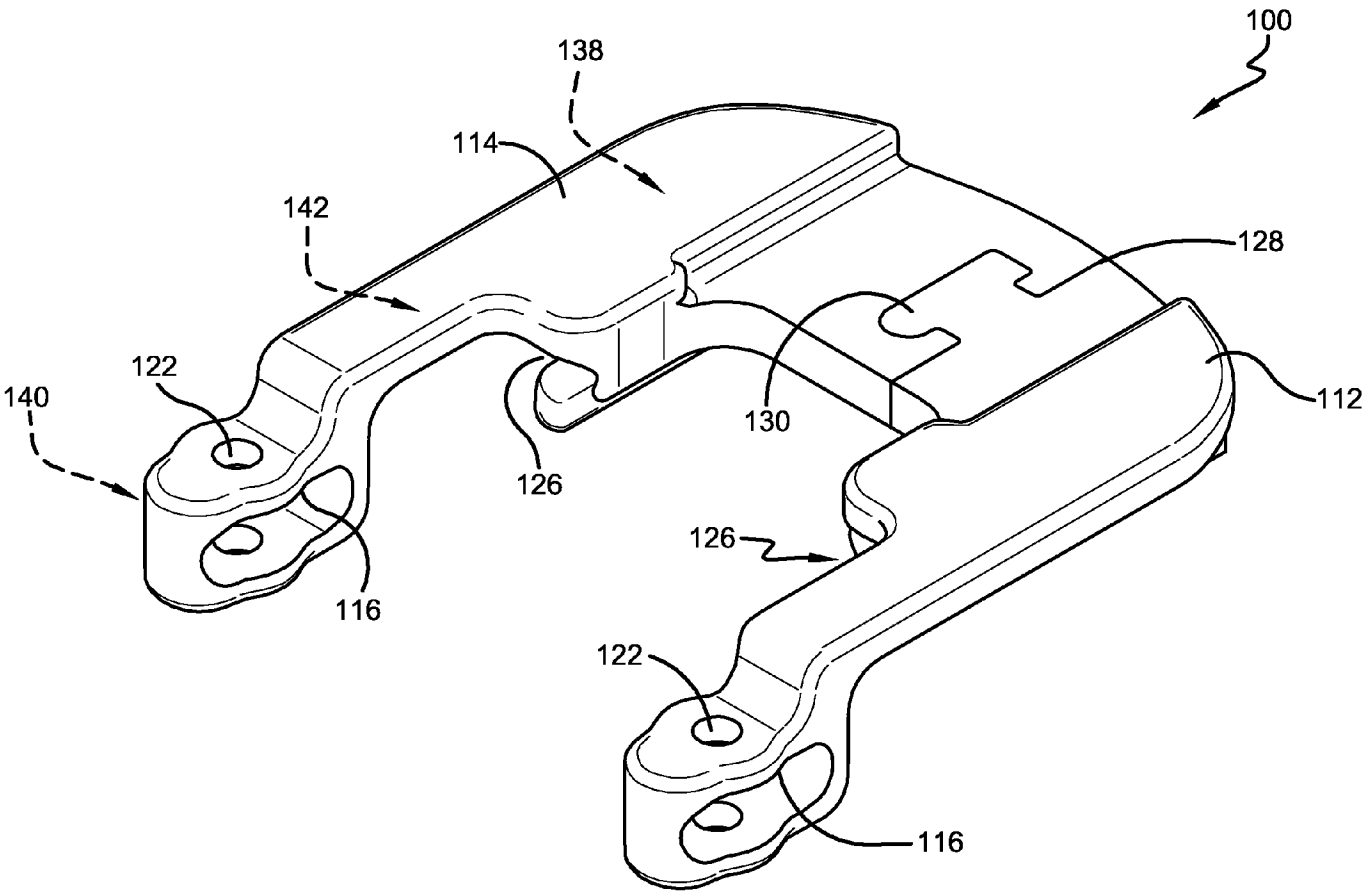
FIG. 7 is a perspective view of an engaging mechanism with the pieces connected together.

When the engaging pieces 112, 114 are connected together, such as shown in FIG. 7, the engaging mechanism 110 has first and second ends 138, 140 and a mid-section 142 between the ends 138 and 142. Thus, the convex and concave portions 130, 132 are positioned at the first end 138, the engaging piece rope reception portions 116 are positioned at the second end 140 and the bowstring contact surfaces 126 are positioned at the mid-section 142 of the engaging mechanism 110. Note that for the embodiment shown, the engaging piece rope reception portions 116 face the engaging piece rope reception portions 116. When the engaging mechanism 110 is connected and used on a crossbow, such as crossbow 200 shown in FIGS. 16 and 17, the first end 138 is the distal end and the second end 140 is the proximal end.

Figure 8:
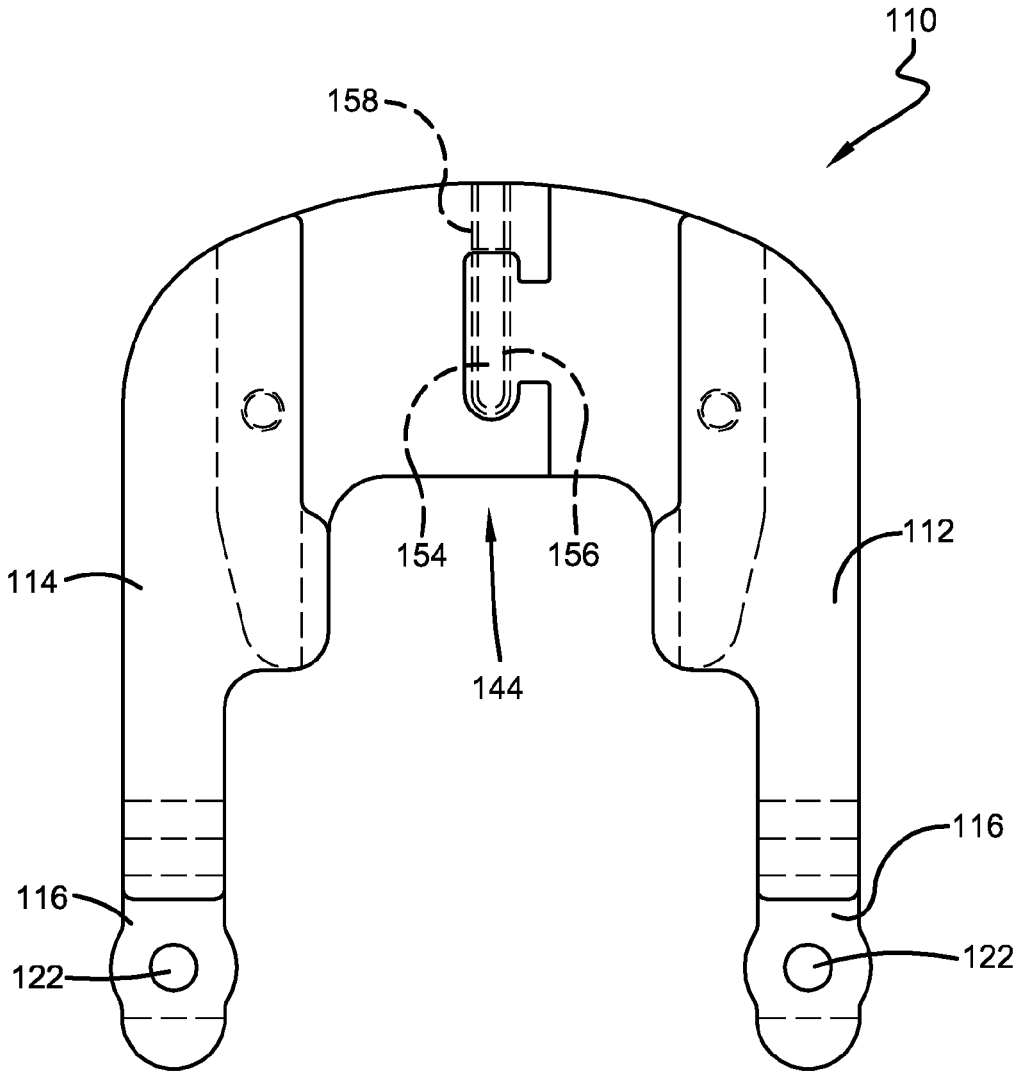
FIG. 8 is a top view of the engaging mechanism shown in FIG. 7.
Figure 9:
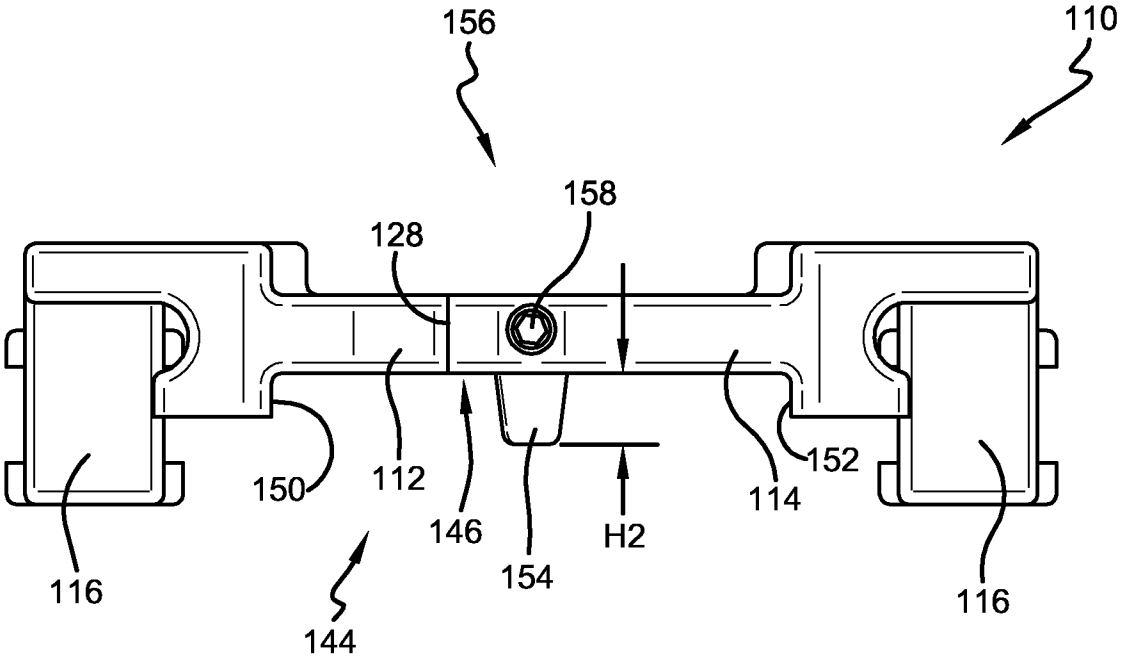
FIG. 9 is an end view of the engaging mechanism shown in FIG. 7.
Figure 10:
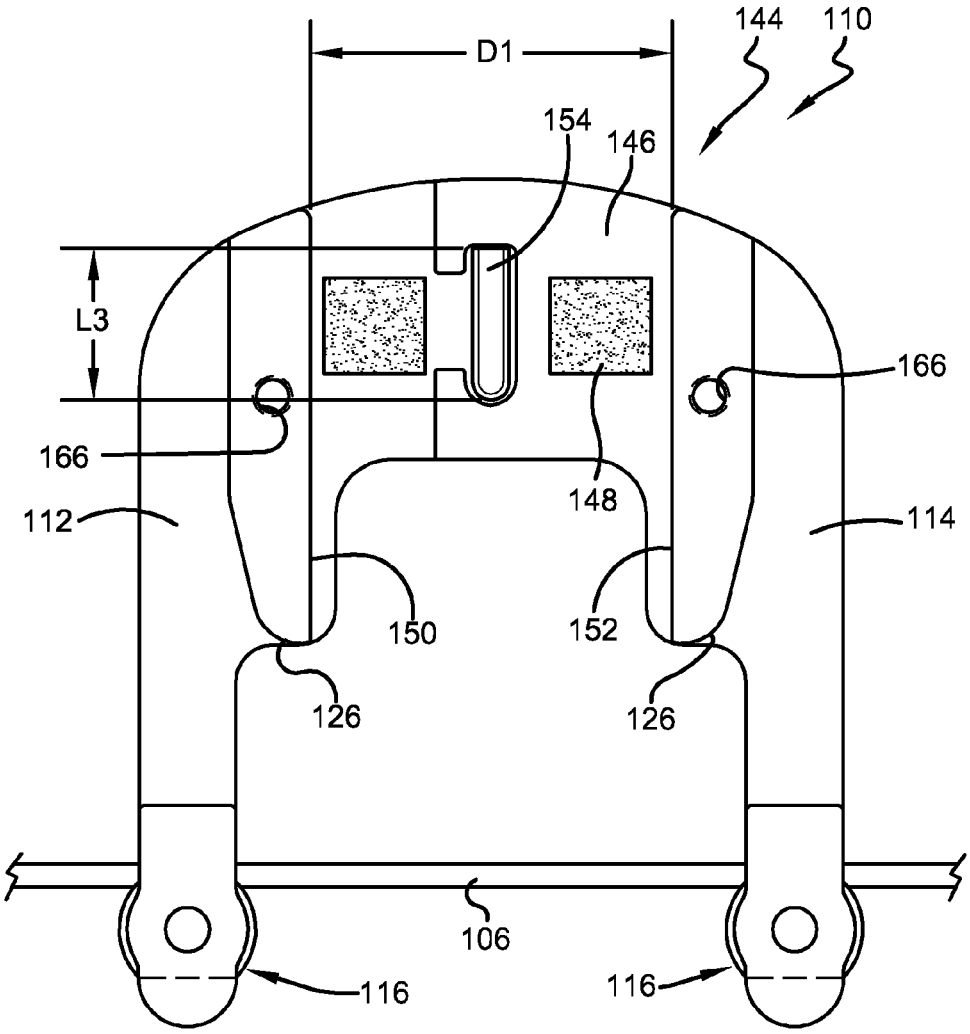
FIG. 10 is a bottom view of an engaging mechanism.
Figure 11:
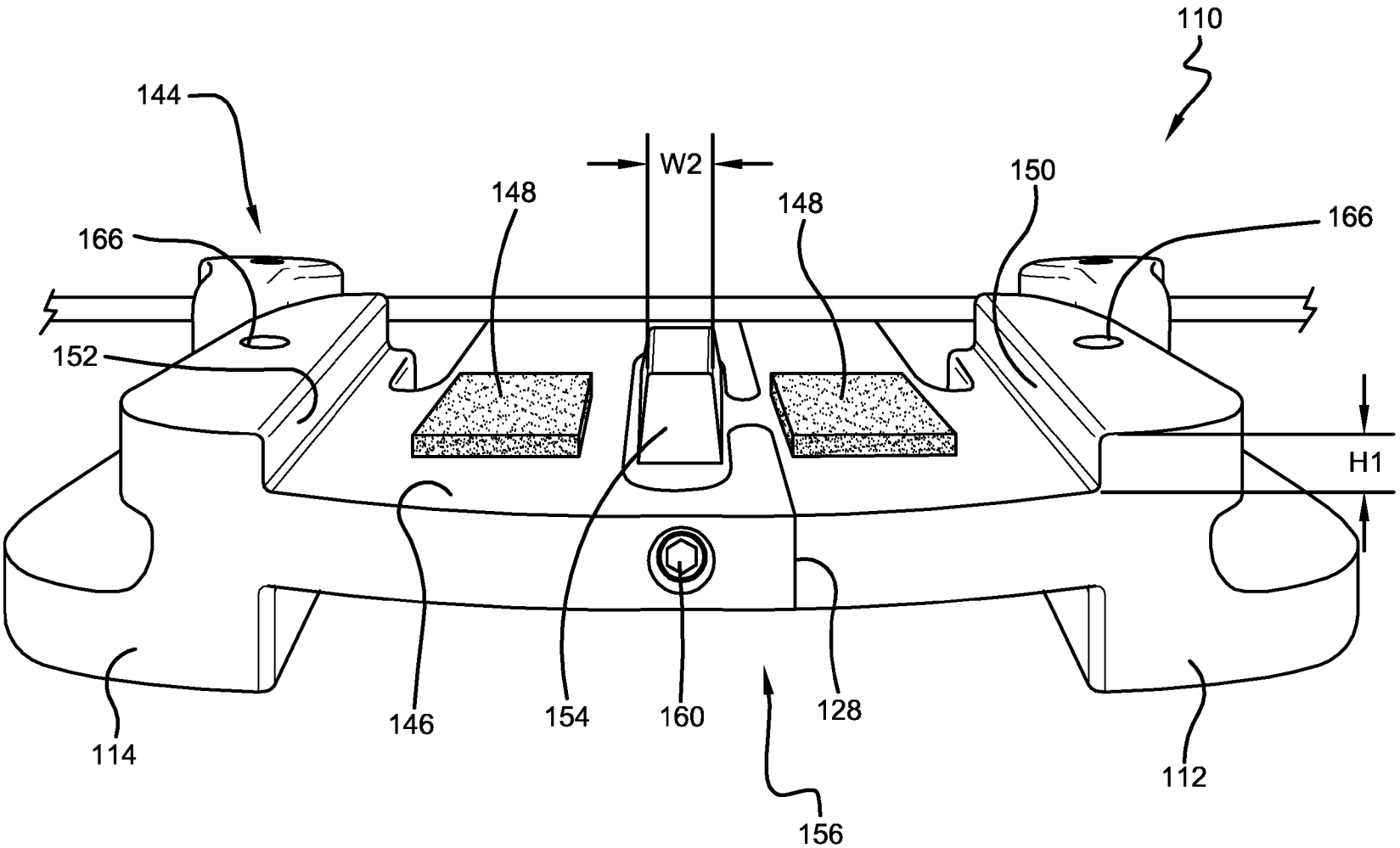
FIG. 11 is a bottom end view of the engaging mechanism shown in FIG. 10.
Figure 11A:
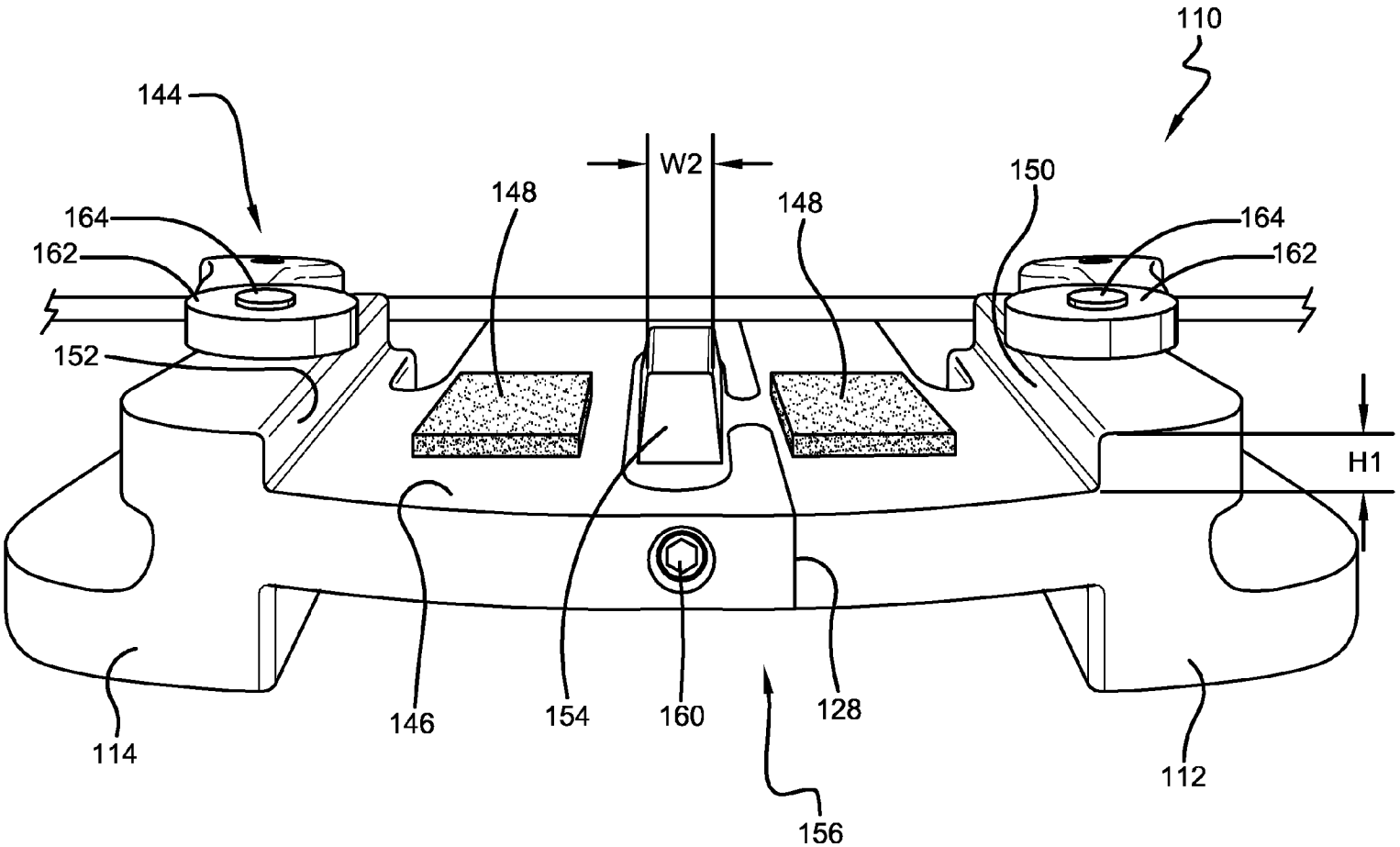
FIG. 11A is a view similar to that shown in FIG. 11 but showing the use of cams.
Figure 16:
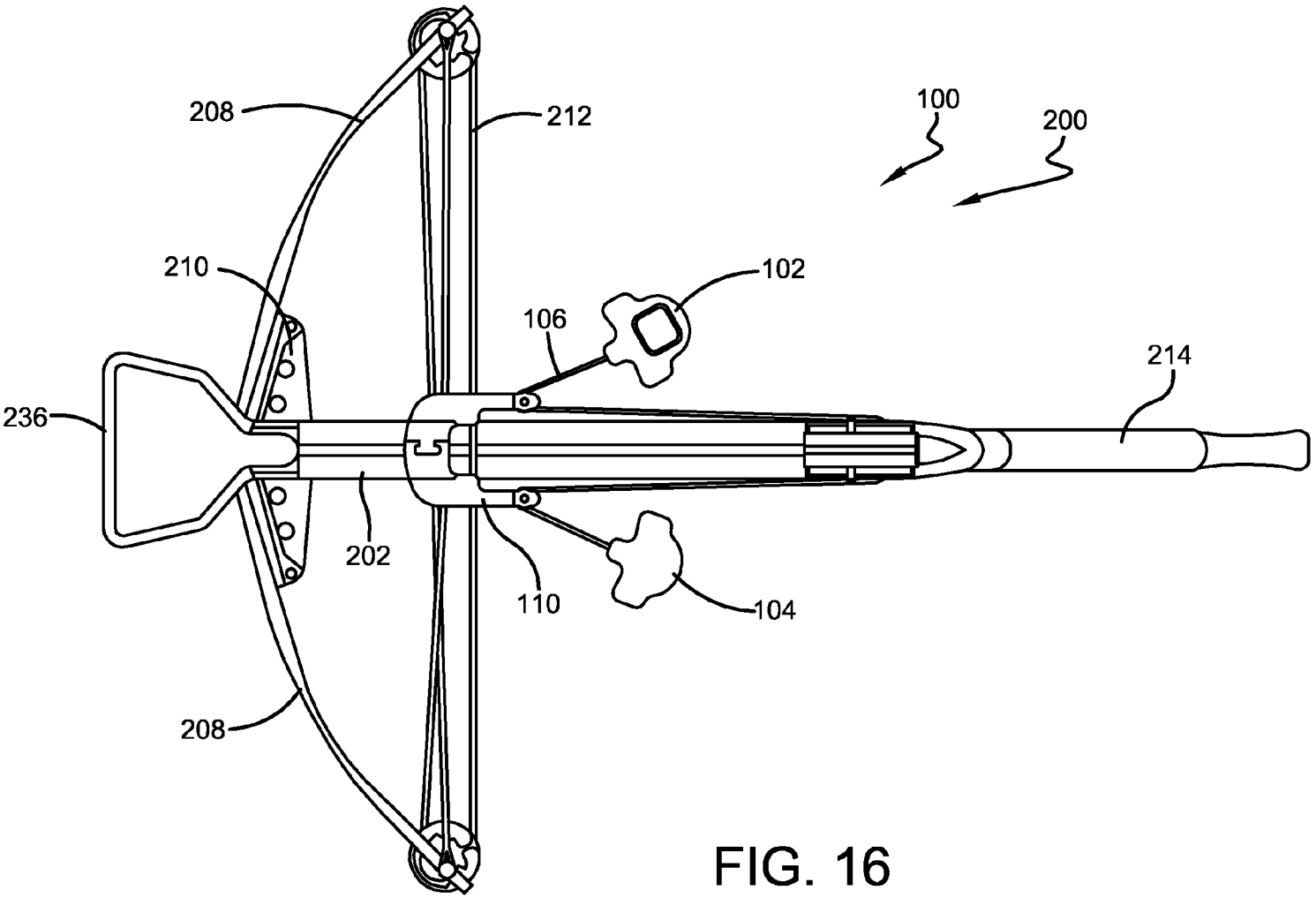
FIG. 16 is a top view of the crossbow of FIG. 5 showing the pieces of the engaging mechanism connected and engaging the bowstring.

With reference now to FIGS. 8-11, the engaging mechanism 110 may have a centering structure 144 that maintains the engaging mechanism 110 in a centered position with respect to the main beam 202, shown in FIGS. 5 and 16-17, as the engaging mechanism 110 is used when the pieces 112, 114 are connected together. The centering structure 144 may include a bottom surface 146 of the engaging mechanism 110, as shown in FIGS. 9-11, that slides on the upper surface 204 of the main beam 202. If desired, as seen best in FIGS. 10 and 11, a padding 148 may be positioned on the bottom surface 146. Such padding 148 may be used to reducing the friction between the bottom surface 204 and the upper surface 204 and/or to reduce wear on the bottom surface 204 and the upper surface 204. The centering structure 144 may include first and second walls 150, 152 that extend from the bottom surface 204. The first and second walls 150, 152 may be separated a distance D1, as shown in FIG. 10. In one embodiment, the distance D1 may be slightly greater than the width W1, shown in FIG. 5, of the main beam 202 so that the first wall 150 is positioned juxtaposed to one side of the main beam 202 and the second wall 152 is positioned juxtaposed to the other side of the main beam 202 when the engaging mechanism 110 is used. In this way the bottom surface 146 and walls 150, 152 form a channel that receives the main beam 202 as the engaging mechanism 110 move relative to the main beam 202. The channel keeps the engaging mechanism 110 centered side to side with respect to the main beam 202 thereby drawing the bowstring 212 in an even/balanced manner as the engaging mechanism 110 draws the bowstring 212 so that both limbs 208, 208 are tensioned to the same degree. The walls 150, 152 may have a height H1, as shown in FIG. 11, which may be any distance chosen with the sound judgment of a person of skill in the art. For the embodiment shown, the walls 150, 152 have a height H1 that is at least 0.1 inches as this height has proven to work well in practice. It is also contemplated to provide the walls 150, 152 with different heights. First wall 150 may be formed on piece 112 and second wall 152 may be formed on piece 114, as shown. In another embodiment, shown in FIG. 11A, at least one cam 162 may be used to center the engaging mechanism 110 to the main beam 202. For the embodiment shown, two cams 162, 162 are used, one placed on each engaging piece 112, 114. The cam(s) 162 may be attached to the engaging mechanism with a connector 164 that extends through the cam 162 and is received in an opening (such as opening 166 shown in FIGS. 10 and 11). The cam(s) 162 may be adjusted, such as by rotating about the connector 164, so that proper centering is achieved. When a cam(s) 162 is used, the distance D1 between first and second walls 150, 152 may be may be significantly greater than the width W1 provided that the cam(s) 162 is sized accordingly.

With continuing reference to FIGS. 8-11, the centering structure 144 may have a centering extension 154 that extends from the bottom surface 146 of the engaging mechanism 110. The centering extension 154 may be received within the arrow reception groove 206 formed on the upper surface 204 of the main beam 202, as seen in FIG. 5. As a result, the centering extension 154 may have a width W2, as shown in FIG. 11, which is slightly smaller than the width of the arrow reception groove 206, shown in FIG. 5. The centering extension 154 received within the arrow reception groove 206 keeps the engaging mechanism 110 centered side to side with respect to the main beam 202 thereby drawing the bowstring 212 in an even/balanced manner as the engaging mechanism 110 draws the bowstring 212 so that both limbs 208 are tensioned to the same degree. To ease the insertion of the centering extension 154 into the arrow reception groove 206, the centering extension 154 may have a smaller width at the distal end with the side walls gradually expanding proximally in width, to width W2. The centering extension 154 may have a length L3, as shown in FIG. 10, and a height H2, as shown in FIG. 9, that are any distances chosen with the sound judgment of a person of skill in the art. For the embodiment shown, length L3 is about 0.6 inches and height H2 is about 0.2 inches as these distances have proven to work well in practice. The centering extension 154 may, in one embodiment, extend from the convex portion 130, as shown. In this case, it may be desirable to make length L3 and width W2 of the centering extension 154 substantially the same as the length L1 and width of the convex portion 130, as shown. It should be noted that in some applications the walls 150, 152 and the centering extension 154 may be used. In other applications either the walls 150, 152 or the centering extension 154 may be used.

Figure 14:
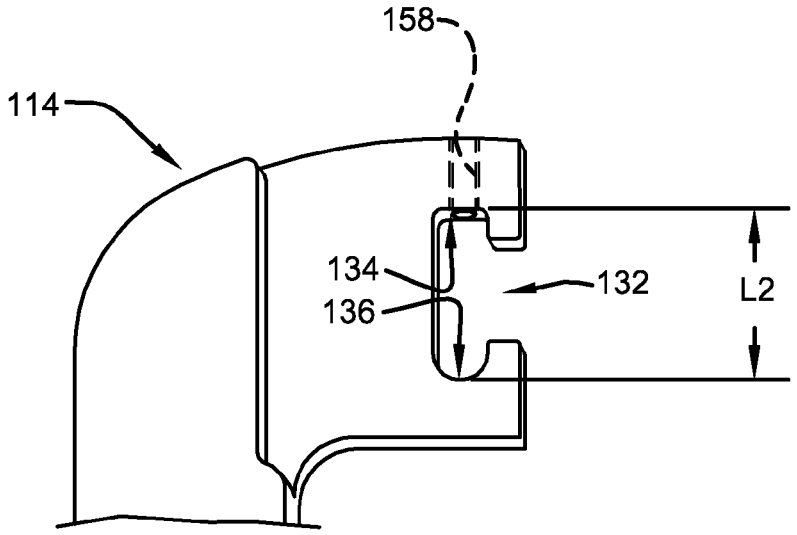
FIG. 14 is a top close up view of a portion of a piece showing a concave portion.

With reference now to FIGS. 8-9 11 and 14, the engaging mechanism 110 may have a securing mechanism 156 that secures engaging piece 112 to engaging piece 114 while they are connected together. The securing mechanism 156 may be of any design chosen with the sound judgment of a person of skill in the art. In one embodiment, the securing mechanism 156 may include an engaging piece opening 158 formed in one of the pieces 112, 114 and a connector 160 that extends into the engaging piece opening 158 and contacts the other piece. For the embodiment shown, the engaging piece opening 158, as shown in FIGS. 8-9 and 14, may be formed in piece 114. Specifically, opening 158 may be positioned in the distal end of piece 114 and may extend from the distal outer surface of the piece 114 into the concave portion 132. In this way, the connector 160, as shown in FIG. 11, may be easily accessed to insert into the opening 158 and adjust until it contacts the distal end of the convex portion 130 of piece 112 or to remove it. In one embodiment, the connector 160 has an outer surface with threads that are received in matching threads formed on the surface of opening 158. In this case, the connector 160 can be rotated, like a screw, within the opening 158 until it contacts the convex portion 130. The securing mechanism 156 may be used when the engaging mechanism 114 is used to draw bowstring 116 and/or used when the engaging mechanism 114 is stored in order to maintain the relative position of the pieces 112, 114.

Figure 15:
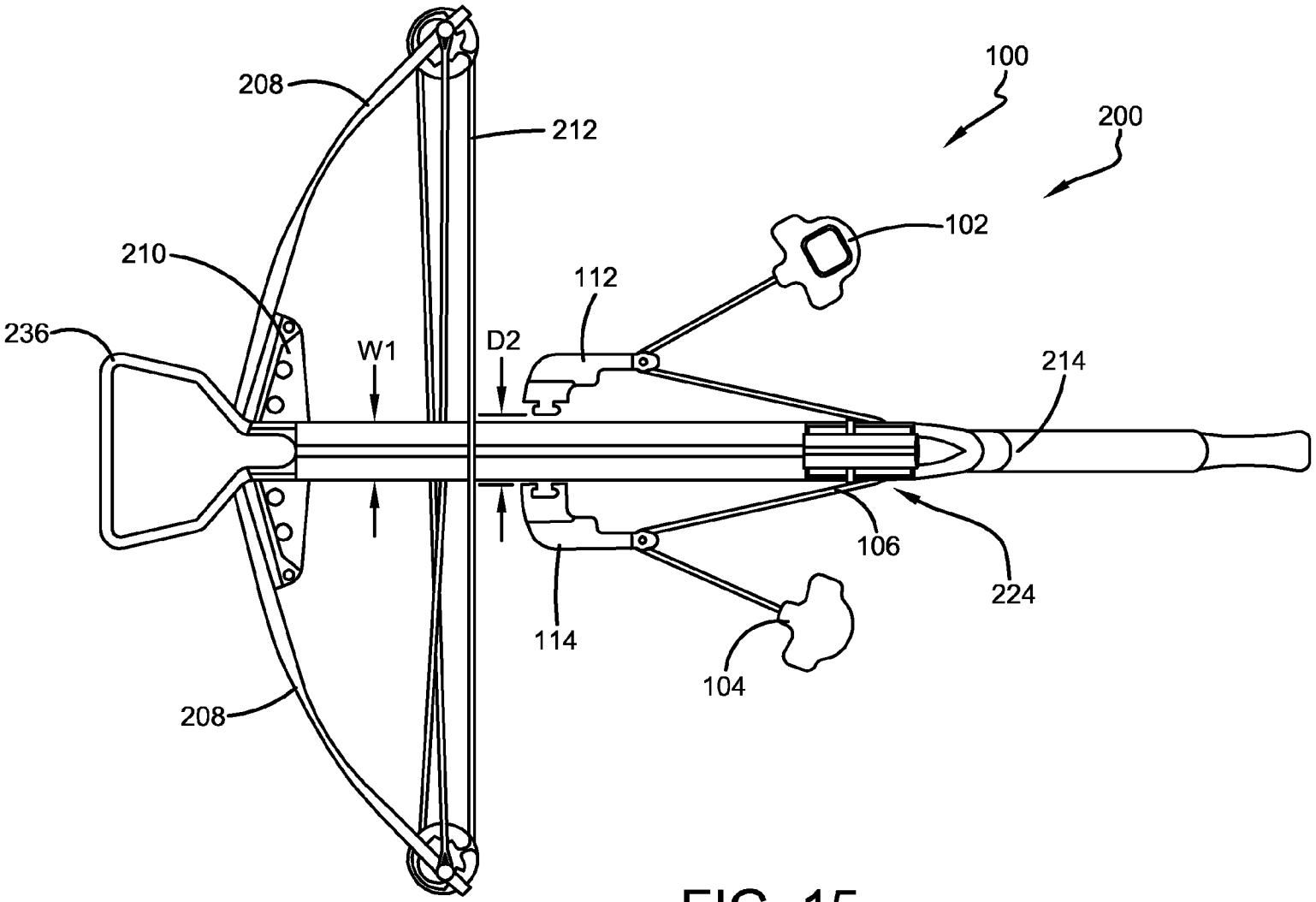
FIG. 15 is a top view of the crossbow of FIG. 5 showing an engaging mechanism being extended toward the bowstring with the pieces separated.

Operation of the drawing mechanism 100 will now be discussed. The crossbow 200 may be in the condition shown in FIG. 5, with the bowstring 212 in the uncocked position. The user may place the distal outer surface of the stirrup bracket 236 on a ground surface and place his foot into the stirrup opening 238 to thereby use his wait to hold the distal end of the stirrup bracket 238 to the ground surface. The user may then, as shown in FIG. 15, position the rope 106 between the handles 102, 104 and between the first and second engaging pieces 112, 114 on one of the crossbow rope reception surfaces 224 (non-limiting examples of crossbow rope reception surfaces 224 are shown in FIG. 6). If a surface forming an opening, such as opening 226, defines the crossbow rope reception surfaces 224, one of the handles and pieces may be inserted through the opening 226. Next, the user may begin extending the handles 102, 104 and pieces 112, 114 toward the bowstring 16 on opposite sides of the main beam 202. As a result, the first and second engaging pieces may be separated by a distance D2 where D2 is at least W1 and the handles 102, 104 and pieces 112, 114 may be positioned longitudinally between the crossbow rope reception surface 224 and the bowstring 212.

Figure 12:
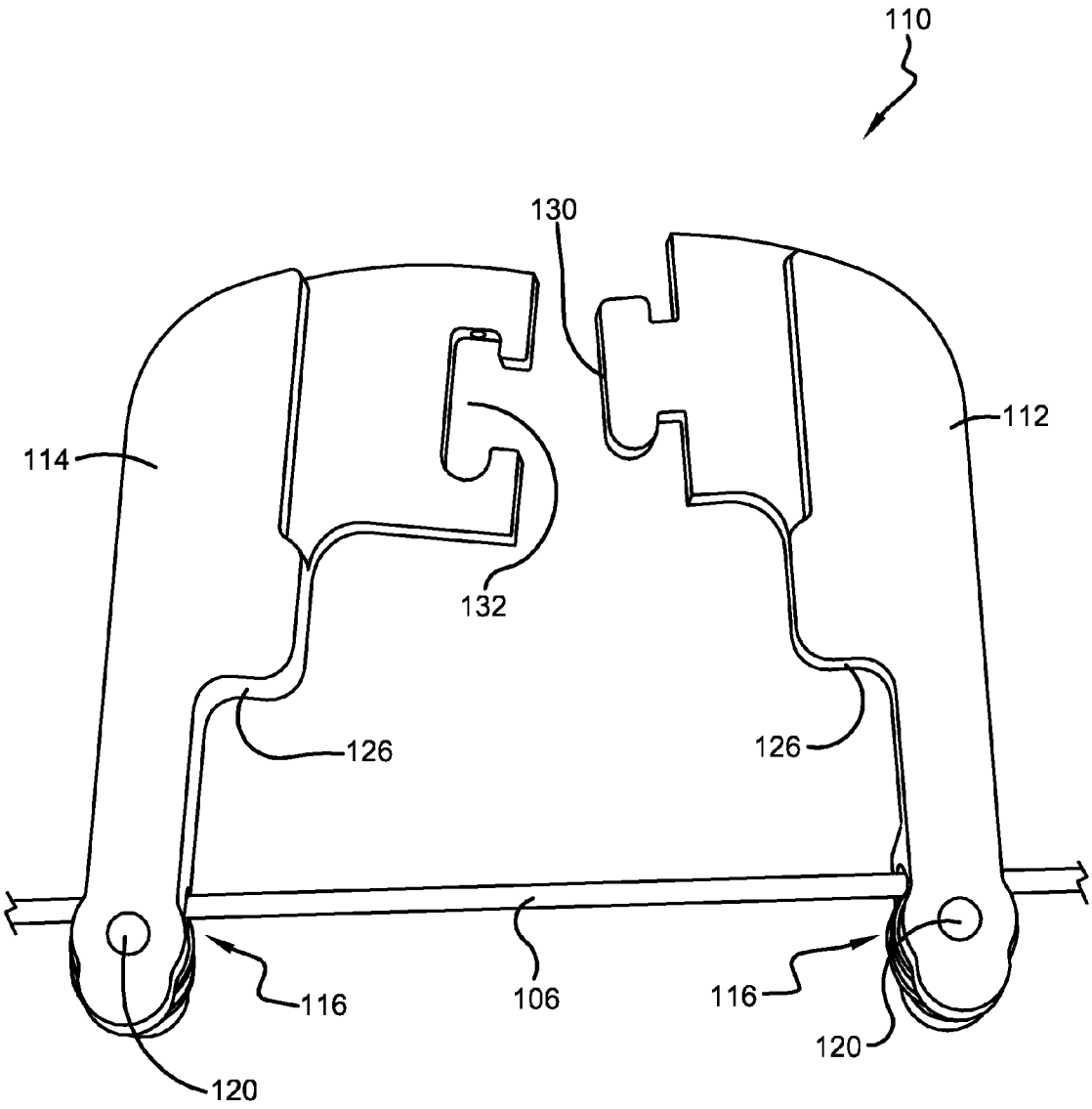
FIG. 12 is a top view of an engaging mechanism shown the pieces separated.
Figure 13:
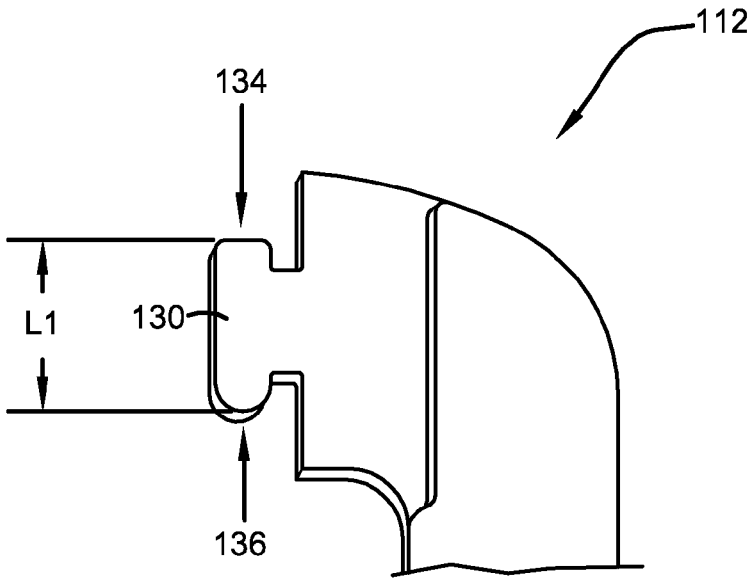
FIG. 13 is a top close up view of a portion of a piece showing a convex portion.

Next, with reference to FIGS. 12 and 16, the user may insert the convex portion 130 of one piece into the concave portion 132 of the other piece thereby connecting the engaging pieces together. In one embodiment, this may be accomplished by positioning the convex portion 130 either above or below the concave portion 132 and then moving the piece 112 with respect to piece 114 to insert the convex portion 130 within the concave portion 132. The user may also contact the bowstring 212 with the bowstring contact surfaces 126 of the pieces 112, 114. If a centering structure 144 is provided, it may be used to engage the main beam 202 as described above.

With reference to FIG. 16, the user may then apply a manual tension force on the handles 102, 104, one hand on each handle, causing the engaging mechanism 110 to move the bowstring 212 proximally from the uncocked position to the cocked position shown in FIG. 17. As explained above, the trigger mechanism 218 may be used to hold the bowstring 212 in the cocked position. The user may then remove the engaging mechanism 110 from the bowstring 212 and, if desired, remove the drawing mechanism 100 from the crossbow 212. The drawing mechanism 100 may then be stored. Once the projectile has been fired, returning the bowstring 212 to the uncocked position shown in FIG. 5, the user may repeat this process to prepare the crossbow 200 for another shot.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof. Further, the "invention" as that term is used in this document is what is claimed in the claims of this document. The right to claim elements and/or sub-combinations that are disclosed herein as other inventions in other patent documents is hereby unconditionally reserved.

We claim:

1. A crossbow, comprising:

a main beam that: extends longitudinally; has first and second sides with a width W1 between the first and second sides; and, has an upper surface suitable to receive an associated projectile to be shot by the crossbow;

first and second limbs supported to the main beam that extend outwardly from proximal ends to distal ends on opposite sides of the main beam;

a bowstring that is: strung between the distal ends of the first and second limbs; and, adjustable from an uncocked position to a cocked position;

a trigger mechanism supported to the main beam and operable to hold the bowstring in the cocked position and operable to release the bowstring to fire the associated projectile;

a crossbow rope reception surface that is longitudinally spaced from the bowstring when the bowstring is in the uncocked position;

a manually assisted bowstring drawing mechanism comprising:

a rope having first and second ends;

a first handle attached to the first end of the rope;

a second handle attached to the second end of the rope; and, an engaging mechanism comprising a first engaging piece comprising: an engaging piece rope reception portion that receives the rope; a bowstring contact surface; and, a convex portion;

a second engaging piece comprising: an engaging piece rope reception portion that receives the rope; a bowstring contact surface; and, a concave portion, wherein the convex portion connectable with the concave portion wherein the manually assisted bowstring drawing mechanism is manually operable into:

(1) a first condition where: (a) the bowstring is in the uncocked position; (b) the rope between the first and second handles and between the first and second engaging pieces contacts the crossbow rope reception surface; (c) the first handle, the first engaging piece and the first end of the rope are positioned on the first side of the main beam longitudinally between the crossbow rope reception surface and the bowstring; (d) the second handle, the second engaging piece and the second end of the rope are positioned on the second side of the main beam longitudinally between the crossbow rope reception surface and the bowstring; and, (e) the first and second engaging pieces are separated by a distance D2 where D2 is at least W1;

(2) a second condition where: (a) the bowstring is in the uncocked position; (b) the rope between the first and second handles and between the first and second engaging pieces contacts the crossbow rope reception surface; (c) the convex portion of the first engaging piece is received in the concave portion of the second engaging piece thereby connecting the first engaging piece to the second engaging piece; (d) the bowstring contact surface of the first engaging piece contacts the bowstring; and, (e) the bowstring contact surface of the second engaging piece contacts the bowstring; and, (3) a third condition where: (a) the convex portion of the first engaging piece remains within the concave portion of the second engaging piece thereby maintaining the connection of the first engaging piece to the second engaging piece; (b) the rope between the first and second handles and between the first and second engaging pieces remains in contact with the crossbow rope reception surface; (c) the bowstring contact surface of the first engaging piece remains in contact with the bowstring; (d) the bowstring contact surface of the second engaging piece remains in contact with the bowstring; and, (e) a tension force applied by an associated user on the first and second handles causes the engaging mechanism to move the bowstring from the uncocked position to the cocked position.

2. The crossbow of claim 1 wherein:

the engaging mechanism further comprises centering structure that substantially maintains the engaging mechanism in a centered position with respect to the main beam during the third condition.

3. The crossbow of claim 2 wherein the centering structure comprises:

a bottom surface of the engaging mechanism that slides on the upper surface of the main beam;

a first wall that extends from the bottom surface of the engaging mechanism and that is positioned juxtaposed to the first side of the main beam; and, a second wall that extends from the bottom surface of the engaging mechanism and that is positioned juxtaposed to the second side of the main beam.

4. The crossbow of claim 2 wherein the centering structure comprises:

a bottom surface of the engaging mechanism that slides on the upper surface of the main beam; and, a centering extension that extends from the bottom surface of the engaging mechanism and that is received within a longitudinally extending arrow reception groove formed on the upper surface of the main beam.

5. The crossbow of claim 1 wherein the engaging mechanism has a securing mechanism that comprises:

an engaging piece opening formed in one of the first and second pieces; and, a connector that extends into the engaging piece opening and contacts the other of the first and second pieces to secure the first engaging piece to the second engaging piece while the convex portion of the first engaging piece is received in the concave portion of the second engaging piece.

6. The crossbow of claim 1 wherein the convex and concave portions are substantially T-shaped.

7. The crossbow of claim 1 wherein when the convex portion of the first engaging piece is received in the concave portion of the second engaging piece thereby connecting the first engaging piece to the second engaging piece:

the engaging mechanism has first and second ends and a mid-section between the first and second ends;

the convex and concave portions are positioned at the first end of the engaging mechanism;

the engaging piece rope reception portions of the first and second engaging pieces are positioned at the second end of the engaging mechanism; and, the bowstring contact surfaces of the first and second engaging pieces are positioned at the mid-section of the engaging mechanism.

8. A manually assisted bowstring drawing mechanism for use with an associated crossbow, wherein:

(A) the associated crossbow comprises:

a main beam that: extends longitudinally; has first and second sides with a width W1 between the first and second sides; and, has an upper surface suitable to receive an associated projectile to be shot by the crossbow;

first and second limbs supported to the main beam that extend outwardly from proximal ends to distal ends on opposite sides of the main beam;

a bowstring that is: strung between the distal ends of the first and second limbs; and, adjustable from an uncocked position to a cocked position;

a trigger mechanism supported to the main beam and operable to hold the bowstring in the cocked position and operable to release the bowstring to fire the associated projectile; and, a crossbow rope reception surface that is longitudinally spaced from the bowstring when the bowstring is in the uncocked position; and, (B) the manually assisted bowstring drawing mechanism comprises:

a rope having first and second ends;

a first handle attached to the first end of the rope;

a second handle attached to the second end of the rope; and, an engaging mechanism comprising a first engaging piece comprising: an engaging piece rope reception portion that receives the rope; a bowstring contact surface; and, a convex portion; and, a second engaging piece comprising: an engaging piece rope reception portion that receives the rope; a bowstring contact surface; and, a concave portion, wherein the convex portion connectable with the concave portion (C) wherein the manually assisted bowstring drawing mechanism is manually operable when used with the associated crossbow into:

(1) a first condition where: (a) the bowstring is in the uncocked position; (b) the rope between the first and second handles and between the first and second engaging pieces contacts the crossbow rope reception surface; (c) the first handle, the first engaging piece and the first end of the rope are positioned on the first side of the main beam longitudinally between the crossbow rope reception surface and the bowstring; (d) the second handle, the second engaging piece and the second end of the rope are positioned on the second side of the main beam longitudinally between the crossbow rope reception surface and the bowstring; and, (e) the first and second engaging pieces are separated by a distance D2 where D2 is at least W1;

(2) a second condition where: (a) the bowstring is in the uncocked position; (b) the rope between the first and second handles and between the first and second engaging pieces contacts the crossbow rope reception surface; (c) the convex portion of the first engaging piece is received in the concave portion of the second engaging piece thereby connecting the first engaging piece to the second engaging piece; (d) the bowstring contact surface of the first engaging piece contacts the bowstring; and, (e) the bowstring contact surface of the second engaging piece contacts the bowstring;

(3) a third condition where: (a) the convex portion of the first engaging piece remains within the concave portion of the second engaging piece thereby maintaining the connection of the first engaging piece to the second engaging piece; (b) the rope between the first and second handles and between the first and second engaging pieces remains in contact with the crossbow rope reception surface; (c) the bowstring contact surface of the first engaging piece remains in contact with the bowstring; (d) the bowstring contact surface of the second engaging piece remains in contact with the bowstring; and, (e) a tension force applied by an associated user on the first and second handles causes the engaging mechanism to move the bowstring from the uncocked position to the cocked position; and, (4) a fourth condition where: (a) the bowstring is in the cocked position; and, (b) the engaging mechanism is removed from the bowstring.

9. The manually assisted bowstring drawing mechanism of claim 8 wherein:

the engaging mechanism further comprises centering structure that substantially maintains the engaging mechanism in a centered position with respect to the main beam during the third condition.

10. The manually assisted bowstring drawing mechanism of claim 9 wherein the centering structure comprises:

a bottom surface of the engaging mechanism that is suitable to slide on the upper surface of the main beam;

a first wall that extends from the bottom surface of the engaging mechanism and that is positionable juxtaposed to the first side of the main beam; and, a second wall that extends from the bottom surface of the engaging mechanism and that is positionable juxtaposed to the second side of the main beam.

11. The manually assisted bowstring drawing mechanism of claim 9 wherein the centering structure comprises:

a bottom surface of the engaging mechanism that is suitable to slide on the upper surface of the main beam; and, a centering extension that extends from the bottom surface of the engaging mechanism and that is positional within a longitudinally extending arrow reception groove formed on the upper surface of the main beam.

12. The manually assisted bowstring drawing mechanism of claim 11 wherein the centering extension extends from the convex portion.

13. The manually assisted bowstring drawing mechanism of claim 8 wherein the engaging mechanism has a securing mechanism that comprises:

an engaging piece opening formed in one of the first and second pieces; and, a connector that extends into the engaging piece opening and contacts the other of the first and second pieces to secure the first engaging piece to the second engaging piece while the convex portion of the first engaging piece is received in the concave portion of the second engaging piece.

14. The manually assisted bowstring drawing mechanism of claim 8 wherein the convex and concave portions are substantially T-shaped.

15. The manually assisted bowstring drawing mechanism of claim 8 wherein when the convex portion of the first engaging piece is received in the concave portion of the second engaging piece thereby connecting the first engaging piece to the second engaging piece:

the engaging mechanism has first and second ends and a mid-section between the first and second ends;

the convex and concave portions are positioned at the first end of the engaging mechanism;

the engaging piece rope reception portions of the first and second engaging pieces are positioned at the second end of the engaging mechanism; and, the bowstring contact surfaces of the first and second engaging pieces are positioned at the mid-section of the engaging mechanism.

16. A method comprising the steps of:

(A) proving a crossbow comprising:

a main beam that: extends longitudinally; has first and second sides with a width W1 between the first and second sides; and, has an upper surface suitable to receive an associated projectile to be shot by the crossbow;

first and second limbs supported to the main beam that extend outwardly from proximal ends to distal ends on opposite sides of the main beam;

a bowstring that is: strung between the distal ends of the first and second limbs; and, adjustable from an uncocked position to a cocked position;

a trigger mechanism supported to the main beam and operable to hold the bowstring in the cocked position and operable to release the bowstring to fire the associated projectile;

a crossbow rope reception surface that is longitudinally spaced from the bowstring when the bowstring is in the uncocked position; and, wherein the bowstring is in the uncocked position;

(B) providing a manually assisted bowstring drawing mechanism comprising:

a rope having first and second ends;

a first handle attached to the first end of the rope;

a second handle attached to the second end of the rope; and, an engaging mechanism comprising:

centering structure;

a first engaging piece comprising: an engaging piece rope reception portion that receives the rope; a bowstring contact surface; and, a convex portion; and, a second engaging piece comprising: an engaging piece rope reception portion that receives the rope; a bowstring contact surface; and, a concave portion, wherein the convex portion connectable with the concave portion (C) while the bowstring remains in the uncocked position: positioning the rope between the first and second handles and between the first and second engaging pieces on the crossbow rope reception surface;

(D) while the bowstring remains in the uncocked position and the rope between the first and second handles and between the first and second engaging pieces remains on the crossbow rope reception surface:

(1) positioning the first handle, the first engaging piece and the first end of the rope on the first side of the main beam longitudinally between the crossbow rope reception surface and the bowstring;

(2) positioning the second handle, the second engaging piece and the second end of the rope on the second side of the main beam longitudinally between the crossbow rope reception surface and the bowstring;

(3) inserting the convex portion of the first engaging piece into the concave portion of the second engaging piece thereby connecting the first engaging piece to the second engaging piece;

(4) contacting the bowstring with the bowstring contact surface of the first engaging piece and the bowstring contact surface of the second engaging piece;

(E) while the rope between the first and second handles and between the first and second engaging pieces remains on the crossbow rope reception surface, the convex portion of the first engaging piece remains inserted within the concave portion of the second engaging piece and the bowstring remains contacted by the bowstring contact surfaces of the first and second engaging pieces: applying a manual tension force on the first and second handles causing the engaging mechanism to move the bowstring from the uncocked position to the cocked position; and, (F) while the bowstring remains in the cocked position: removing the engaging mechanism from the bowstring.

17. The method of claim 16 wherein:

step (B) comprises the step of providing the engaging mechanism with a centering structure comprising: a bottom surface of the engaging mechanism; a first wall that extends from the bottom surface of the engaging mechanism; and, a second wall that extends from the bottom surface of the engaging mechanism;

step (D) comprises the step of positioning the engaging mechanism onto the crossbow with: the bottom surface of the engaging mechanism contacting the upper surface of the main beam; the first wall positioned juxtaposed to the first side of the main beam; and, the second wall positioned juxtaposed to the second side of the main beam; and, step (E) comprises the step of: using the centering structure to substantially maintain the engaging mechanism in a centered position with respect to the main beam while the engaging mechanism is moving the bowstring from the uncocked position to the cocked position.

18. The method of claim 16 wherein:

step (A) comprises the step of: providing a longitudinally extending arrow reception groove formed on the upper surface of the main beam;

step (B) comprises the step of providing the engaging mechanism with a centering structure comprising: a bottom surface of the engaging mechanism; and, a centering extension that extends from the bottom surface of the engaging mechanism;

step (D) comprises the step of positioning the engaging mechanism onto the crossbow with: the bottom surface of the engaging mechanism contacting the upper surface of the main beam; and, the centering extension positioned within the arrow reception groove; and, step (E) comprises the step of: using the centering structure to substantially maintain the engaging mechanism in a centered position with respect to the main beam while the engaging mechanism is moving the bowstring from the uncocked position to the cocked position.

19. The method of claim 16 wherein step (D)(3) comprises the steps of:

positioning the convex portion one of above the concave portion and below the concave portion; and, moving the first engaging piece with respect to the second engaging piece to insert the convex portion within the concave portion.

20. The method of claim 16 wherein:

step (A) comprises the step of: providing the crossbow with a stirrup bracket supported to the main beam that defines a stirrup opening; and, step (E) comprises the step of: using a foot positioned within the stirrup opening to hold the crossbow to a ground surface while the manual tension force is applied to the first and second handles.

* * * * *